US009028349B2

(12) United States Patent
Budris et al.

(10) Patent No.: US 9,028,349 B2
(45) Date of Patent: May 12, 2015

(54) CONFIGURABLE BROADHEAD ARROWHEAD

(71) Applicants: Christopher Budris, Cheshire, CT (US); Franco Pezza, Wallingford, CT (US)

(72) Inventors: Christopher Budris, Cheshire, CT (US); Franco Pezza, Wallingford, CT (US)

( * ) Notice: Subject to any disclaimer, the term of this patent is extended or adjusted under 35 U.S.C. 154(b) by 46 days.

(21) Appl. No.: 14/041,807

(22) Filed: Sep. 30, 2013

(65) Prior Publication Data

US 2014/0031152 A1 Jan. 30, 2014

Related U.S. Application Data

(63) Continuation-in-part of application No. 13/070,730, filed on Mar. 24, 2011, now Pat. No. 8,545,349.

(60) Provisional application No. 61/754,731, filed on Jan. 21, 2013.

(51) Int. Cl.
*F42B 6/08* (2006.01)
*F42B 6/00* (2006.01)

(52) U.S. Cl.
CPC ..... *F42B 6/08* (2013.01)

(58) Field of Classification Search
CPC ..... F42B 6/08
USPC ..... 473/583, 584
See application file for complete search history.

(56) References Cited

U.S. PATENT DOCUMENTS 2,568,417 A * 9/1951 Steinbacher ..... 473/583
3,036,395 A * 5/1962 Nelson ..... 43/6
3,578,328 A * 5/1971 Rickey ..... 473/583
3,738,657 A * 6/1973 Cox ..... 473/585
4,099,720 A * 7/1978 Zeren ..... 473/584
4,166,619 A * 9/1979 Bergmann et al. ..... 473/581
4,452,460 A * 6/1984 Adams ..... 473/584
4,579,348 A * 4/1986 Jones ..... 473/583
4,615,529 A * 10/1986 Vocal ..... 473/583
4,932,671 A * 6/1990 Anderson, Jr. ..... 473/583
4,940,246 A * 7/1990 Stagg ..... 473/583
4,973,060 A * 11/1990 Herzing ..... 473/583
4,976,443 A * 12/1990 DeLucia ..... 473/583

(Continued)

OTHER PUBLICATIONS

G5 Outdoors, http://www.g5outdoors.com/#sec_t3, T3 Broadhead.

(Continued)

*Primary Examiner* — Alvin Hunter
*Assistant Examiner* — Alexander Niconovich
(74) *Attorney, Agent, or Firm* — Steven M. McHugh

(57) ABSTRACT

A rear deploying mechanical broadhead arrowhead is provided and includes a broadhead body having a body opening and a body length, wherein the broadhead body defines a body cavity and includes a plurality of slots, wherein each of the plurality of slots traverses a portion of the body length and is disposed such that each of the plurality of slots is on an opposing side of the broadhead body. A blade system is also provided and includes minor blades and deployable blades, wherein the deployable blades are movable relative to the minor blades. The blade system is movably disposed within the body cavity such that the plurality of minor blades and plurality of deployable blades are protruding from the plurality of slots. A broadhead base having a base head securely associated with the body opening to be partially disposed within the body cavity to enclose the body cavity.

7 Claims, 41 Drawing Sheets

(56) References Cited

U.S. PATENT DOCUMENTS

| | | | | | |
|---|---|---|---|---|---|
| 4,998,738 | A * | 3/1991 | Puckett | 473/583 |
| 5,046,744 | A * | 9/1991 | Eddy | 473/583 |
| 5,066,021 | A * | 11/1991 | DeLucia | 473/583 |
| 5,078,407 | A * | 1/1992 | Carlston et al. | 473/583 |
| 5,082,292 | A * | 1/1992 | Puckett et al. | 473/583 |
| 5,083,798 | A * | 1/1992 | Massey | 473/583 |
| 5,090,709 | A * | 2/1992 | Johnson | 473/584 |
| 5,100,143 | A * | 3/1992 | Puckett | 473/583 |
| 5,102,147 | A * | 4/1992 | Szeluga | 473/584 |
| 5,112,063 | A * | 5/1992 | Puckett | 473/583 |
| 5,172,916 | A * | 12/1992 | Puckett | 473/583 |
| 5,178,398 | A * | 1/1993 | Eddy | 473/583 |
| 5,322,297 | A * | 6/1994 | Smith | 473/583 |
| 5,372,588 | A * | 12/1994 | Farley et al. | 604/170.01 |
| 5,458,341 | A * | 10/1995 | Forrest et al. | 473/583 |
| 5,472,213 | A * | 12/1995 | Dudley | 473/583 |
| 5,564,713 | A * | 10/1996 | Mizek et al. | 473/583 |
| 5,803,844 | A * | 9/1998 | Anderson | 473/583 |
| 5,803,845 | A * | 9/1998 | Anderson | 473/583 |
| 5,820,498 | A * | 10/1998 | Maleski | 473/584 |
| 5,857,930 | A * | 1/1999 | Troncoso | 473/583 |
| 5,879,252 | A * | 3/1999 | Johnson | 473/583 |
| 5,941,784 | A * | 8/1999 | Mizek | 473/584 |
| 6,015,357 | A * | 1/2000 | Rizza | 473/583 |
| 6,200,237 | B1 * | 3/2001 | Barrie | 473/583 |
| 6,258,000 | B1 * | 7/2001 | Liechty, II | 473/583 |
| 6,270,435 | B1 * | 8/2001 | Sodaro | 473/583 |
| 6,283,880 | B1 * | 9/2001 | Barrie | 473/584 |
| 6,290,903 | B1 * | 9/2001 | Grace et al. | 419/28 |
| 6,322,464 | B1 * | 11/2001 | Sestak | 473/583 |
| 6,428,433 | B1 * | 8/2002 | Liechty, II | 473/583 |
| 6,428,434 | B1 * | 8/2002 | Liechty, II | 473/583 |
| 6,554,727 | B1 * | 4/2003 | Armstrong et al. | 473/584 |
| 6,595,881 | B1 * | 7/2003 | Grace et al. | 473/583 |
| 6,830,523 | B1 * | 12/2004 | Kuhn | 473/583 |
| 6,910,979 | B2 * | 6/2005 | Barrie et al. | 473/583 |
| 6,935,976 | B1 * | 8/2005 | Grace et al. | 473/583 |
| 7,226,375 | B1 * | 6/2007 | Sanford | 473/583 |
| 7,234,220 | B1 * | 6/2007 | Grace, Jr. | 29/428 |
| 7,677,995 | B1 * | 3/2010 | Sanford | 473/583 |
| 7,713,151 | B2 | 5/2010 | Fulton | |
| 7,713,152 | B1 * | 5/2010 | Tentler et al. | 473/583 |
| 7,717,814 | B1 * | 5/2010 | Sanford | 473/583 |
| 8,007,382 | B1 * | 8/2011 | Sanford | 473/583 |
| 8,105,187 | B1 * | 1/2012 | Sanford | 473/583 |
| 8,128,521 | B1 * | 3/2012 | Ulmer | 473/583 |
| 8,147,361 | B1 * | 4/2012 | Weaver | 473/583 |
| 8,210,970 | B1 * | 7/2012 | Sanford | 473/583 |
| 8,210,971 | B1 * | 7/2012 | Fulton | 473/583 |
| 2002/0098926 | A1 * | 7/2002 | Liechty, II | 473/583 |
| 2002/0151393 | A1 * | 10/2002 | Liechty, II | 473/578 |
| 2003/0004021 | A1 * | 1/2003 | Barrie et al. | 473/583 |
| 2003/0153417 | A1 * | 8/2003 | Barrie et al. | 473/583 |
| 2007/0161438 | A1 * | 7/2007 | Fulton | 473/583 |
| 2008/0045363 | A1 * | 2/2008 | Pulkrabek | 473/583 |
| 2008/0234079 | A1 * | 9/2008 | Butcher | 473/584 |
| 2009/0111621 | A1 * | 4/2009 | Mizek | 473/584 |
| 2009/0203477 | A1 * | 8/2009 | Mizek et al. | 473/583 |
| 2010/0113196 | A1 * | 5/2010 | Jones | 473/583 |

OTHER PUBLICATIONS

G5 Outdoors, http://www.g5outdoors.com/#sec_tekan, Tekan Broadhead.

RAGEtm Broadheads, http://www.ragebroadheads.com/Products/2-Blade-Broadhead.php, 2 Blade Broadhead.

RAGEtm Broadheads, http://www.ragebroadheads.com/Products/3-Blade-Broadhead.php, 3 Blade Broadhead.

* cited by examiner

*Section A-A*

110

*Section B-B*

300

CONFIGURABLE BROADHEAD ARROWHEAD

RELATED APPLICATIONS

This application is a Continuation-in-Part of co-pending U.S. patent application Ser. No. 13/070,730 filed Mar. 24, 2011 and claims the benefit of the filing dates of U.S. patent application Ser. No. 13/070,730 filed Mar. 24, 2011 and U.S. Provisional Patent Application Ser. No. 61/754,731 filed Jan. 21, 2013 the contents of both of which are incorporated by reference herein in their entireties.

FIELD OF THE INVENTION

The present invention relates generally to arrowheads and more particularly to broadhead type arrowheads used for hunting, where the broadhead includes blades that deploy upon contact with an object.

BACKGROUND OF THE INVENTION

Broadhead arrowheads are well known in the art and generally include two main types, the fixed-blade type and the mechanical type, with the latter gaining popularity within the last 20 years. As the name implies, the fixed-blade type of broadhead typically includes blades that are fixed to the broadhead and that are immovable. On the other hand, the mechanical type of broadhead arrowheads typically includes one or more blades that move or deploy into a cutting position upon contact with an object. Although fixed-blade broadheads offer higher penetrating ability, the mechanical type broadheads have several benefits over the fixed-blade type broadheads. One such benefit includes better aerodynamics that results in less wind resistance during flight. This is because when the arrow is in flight the blades are in the non-deployed configuration which results in a more streamlined arrowhead. Another such benefit includes a larger cutting diameter upon interaction with the object.

To date at least two types of mechanical broadhead designs have been developed and include front deploying broadheads and rear deploying broadheads. As the names imply, front deploying broadheads have blades that deploy in the front area of the broadhead, while rear deploying broadheads have blades that deploy in the rear area of the broadhead. Unfortunately, current broadhead designs have several disadvantages. One such disadvantage involves the deployment mechanisms for keeping the blades retracted during flight. Because the blades must deploy readily upon contact with a body or object, the deployment mechanism is typically designed to allow for quick and easy deployment. If the deployment mechanism is too easily triggered, this can result in the wind resistance during flight triggering the deployment of the blades. This changes the aerodynamics of the broadhead causing the arrow to decrease in speed and typically affecting the accuracy of the arrow. Another such problem involves the complexity of the deployable blade mechanisms and the ability to keep the broadhead clean. For example, one broadhead design includes at least six moving components, each of which are embedded in the body and each of which move independently of each other. For operational purposes it is imperative that these head components remain clean and free of corrosion and/or debris. However, the typical bow hunter will be caught in rain and snow storms as well as muddy and extremely humid weather conditions that are common during the fall season. This allows for rapid corrosion and/or freezing of the components resulting in a failure of the blades to deploy.

Thus, it is desirable to make an improved version of a broadhead arrowhead, where the blades are quickly and easily deployable while at the same time providing blades that remain retracted during flight and that are resistant to external weather and environmental conditions.

SUMMARY OF THE INVENTION

A rear deploying mechanical broadhead arrowhead, is provided and includes a broadhead body having a body opening and a body length, wherein the broadhead body defines a body cavity and includes a first, second, third and fourth slot each of which having a slot length that traverses a portion of the body length. Also included is a first minor blade having a first blade portion and a first blade base, the first blade base having interface pins protruding therefrom, a second minor blade having a second blade portion and a second blade base, the second blade base defining pin cavities, wherein the two pin cavities are sized and shaped to contain at least a portion of the two interface pins, a first deployable blade having a first interface hole and a first blade edge and a second deployable blade having a second interface hole and a second blade edge, wherein the first deployable blade and second deployable blade is associated with the first minor blade and second minor blade such that one of the interface pins is located within the first interface hole such that a portion of the first interface pin is protruding therefrom and the other of the interface pins is located within the second interface hole such that a portion of the second interface pin is protruding therefrom. The protruding portion of the first interface pin is located within one of the pin cavities and the second interface pin is located within the other of the pin cavities, the combination of the first deployable blade, second deployable blade, first minor blade and second minor blade being disposed within the body cavity such that the first deployable blade is protruding from the first slot, the second deployable blade is protruding from the second slot, the first minor blade is protruding from the third slot and the second minor blade is protruding from the fourth slot and a broadhead base having a base head, wherein the base head is configured to be securely associated with the body opening to be partially disposed within the body cavity to enclose the body cavity.

A method for assembling a mechanical broadhead arrowhead is provided, wherein the mechanical broadhead arrowhead includes a broadhead body having a plurality of slots, a first minor blade, a second minor blade, a plurality of deployable blades having an O-Ring cutout, an O-Ring and a broadhead base. The method includes associating the O-Ring with the base head such that O-Ring is located within an O-Ring channel of the base head, associating a first deployable blade with the first minor blade and a second deployable blade with the second minor blade, associating the second minor blade with the first minor blade such that the first deployable blade and second deployable blade are disposed perpendicular to the first minor blade and second minor blade, locating the combination of the first minor blade, second minor blade, first deployable blade and second deployable blade within the body cavity of the broadhead body and associating the broadhead base with the broadhead body, configuring the first deployable blade and second deployable blade into a non-deployed configuration and associating the O-Ring with the first deployable blade and second deployable blade to keep the first deployable blade and second deployable blade in the non-deployed configuration.

A rear deploying mechanical broadhead arrowhead is provided and includes a broadhead body having a body opening and a body length, wherein the broadhead body defines a body cavity and includes a plurality of slots, wherein each of the plurality of slots traverses a portion of the body length and is disposed along the circumference of the broadhead body such that each of the plurality of slots is on an opposing side of the broadhead body. A blade system is also provided, wherein the blade system includes a plurality of minor blades and a plurality of deployable blades, the plurality of deployable blades being movable relative to the minor blades, and wherein the blade system is movably disposed within the body cavity such that the plurality of minor blades and plurality of deployable blades are protruding from the plurality of slots. Additionally, a broadhead base having a base head is provided, wherein the base head is configured to be securely associated with the body opening to be partially disposed within the body cavity to enclose the body cavity.

A broadhead arrowhead that is configurable between a fixed blade system and a deployable blade system is provided and includes a broadhead body having a body opening and a body length, wherein the broadhead body defines a body cavity and includes a first, second, third and fourth slot each of which having a slot length that traverses a portion of the body length. The broadhead arrowhead further includes a minor blade system having a first curved surface and a second curved surface, wherein the minor blade system is associated with the broadhead body such that the first curved surface and second curved surface are protruding from opposing sides of the broadhead body. Additionally, the broadhead arrowhead includes a primary blade system configurable between a deployable blade system and a fixed blade system, wherein when the primary blade system is configured as a deployable blade system, the minor blade system is movably associated with the broadhead body and the deployable blade system includes, a first deployable blade having a first interface hole and a first blade edge; a second deployable blade having a second interface hole and a second blade edge, wherein the first deployable blade and second deployable blade are associated with the minor blade system such that movement of the minor blade system causes movement of the deployable blade system, wherein the first and second deployable blades are protruding from opposing sides of the broadhead body. When the primary blade system is configured as a fixed blade system, the minor blade system is non-movably associated with the broadhead body and the fixed blade system includes, a blade insert body non-movably associated with the broadhead body, wherein the blade insert body includes a first insert blade surface and a second insert blade surface, wherein the first and second insert blade surfaces are protruding from opposing sides of the broadhead body. The broadhead arrowhead also includes a broadhead base having a base head, wherein the base head is configured to be securely associated with the body opening to be partially disposed within the body cavity to enclose the body cavity.

BRIEF DESCRIPTION OF THE DRAWINGS

The foregoing and other features and advantages of the present invention should be more fully understood from the accompanying detailed description of illustrative embodiments taken in conjunction with the following Figures in which like elements are numbered alike in the several Figures.

DETAILED DESCRIPTION OF THE INVENTION

Figure 1A:
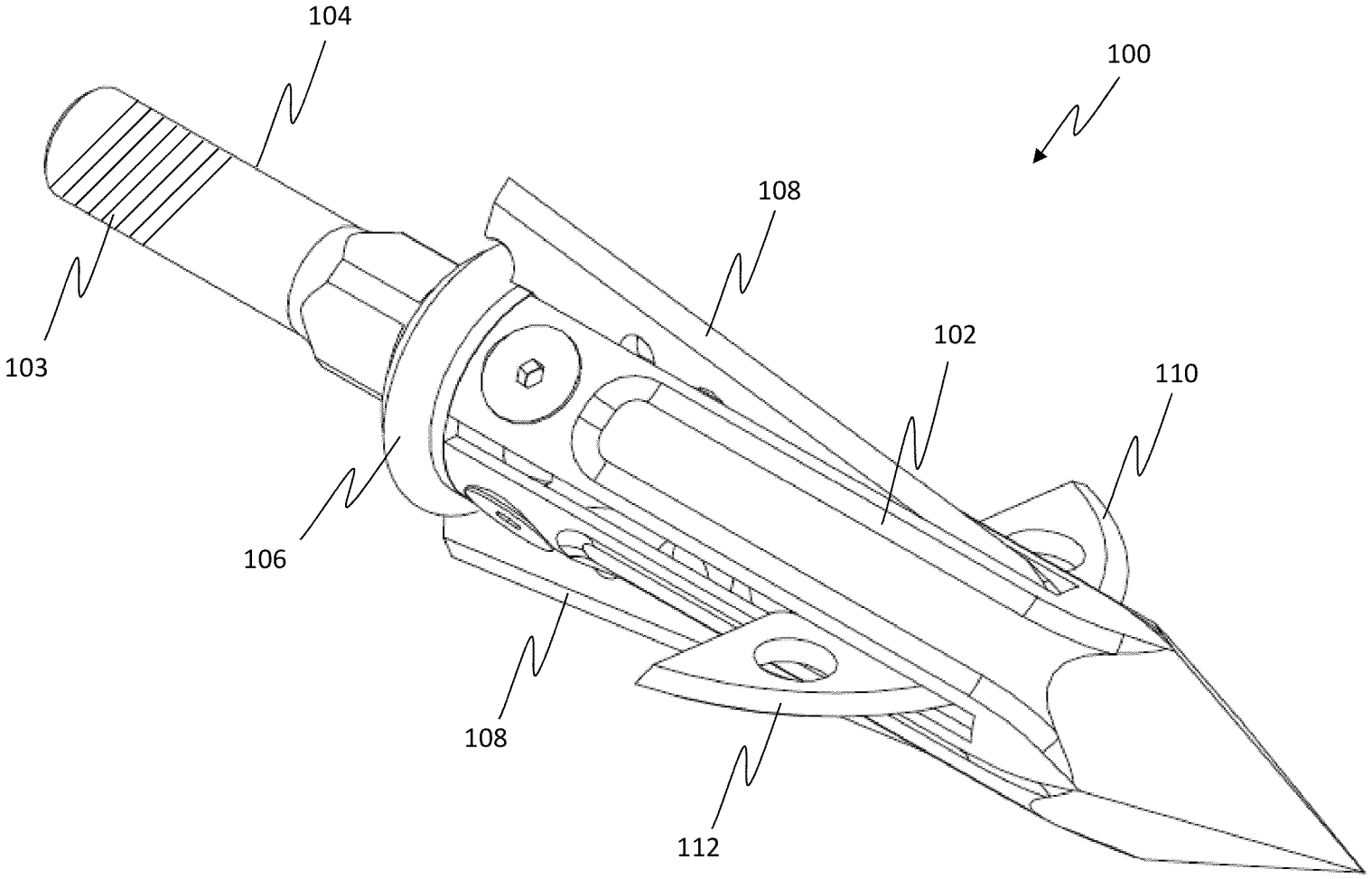
FIG. 1*a* is an isometric view of an improved mechanical broadhead arrowhead, in accordance with the present invention.
Figure 1B:
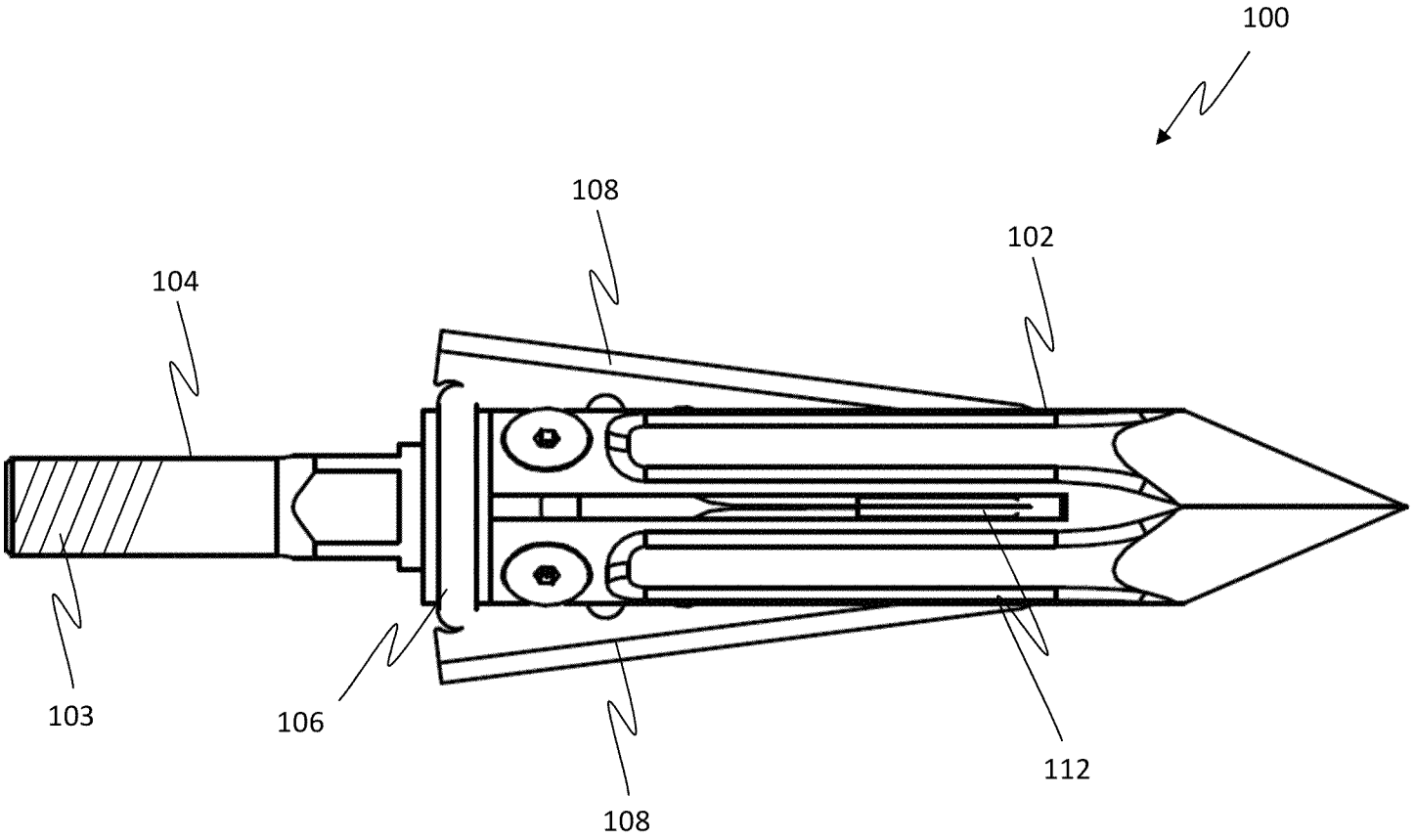
FIG. 1*b* is side view of the broadhead arrowhead of FIG. 1.
Figure 1C:
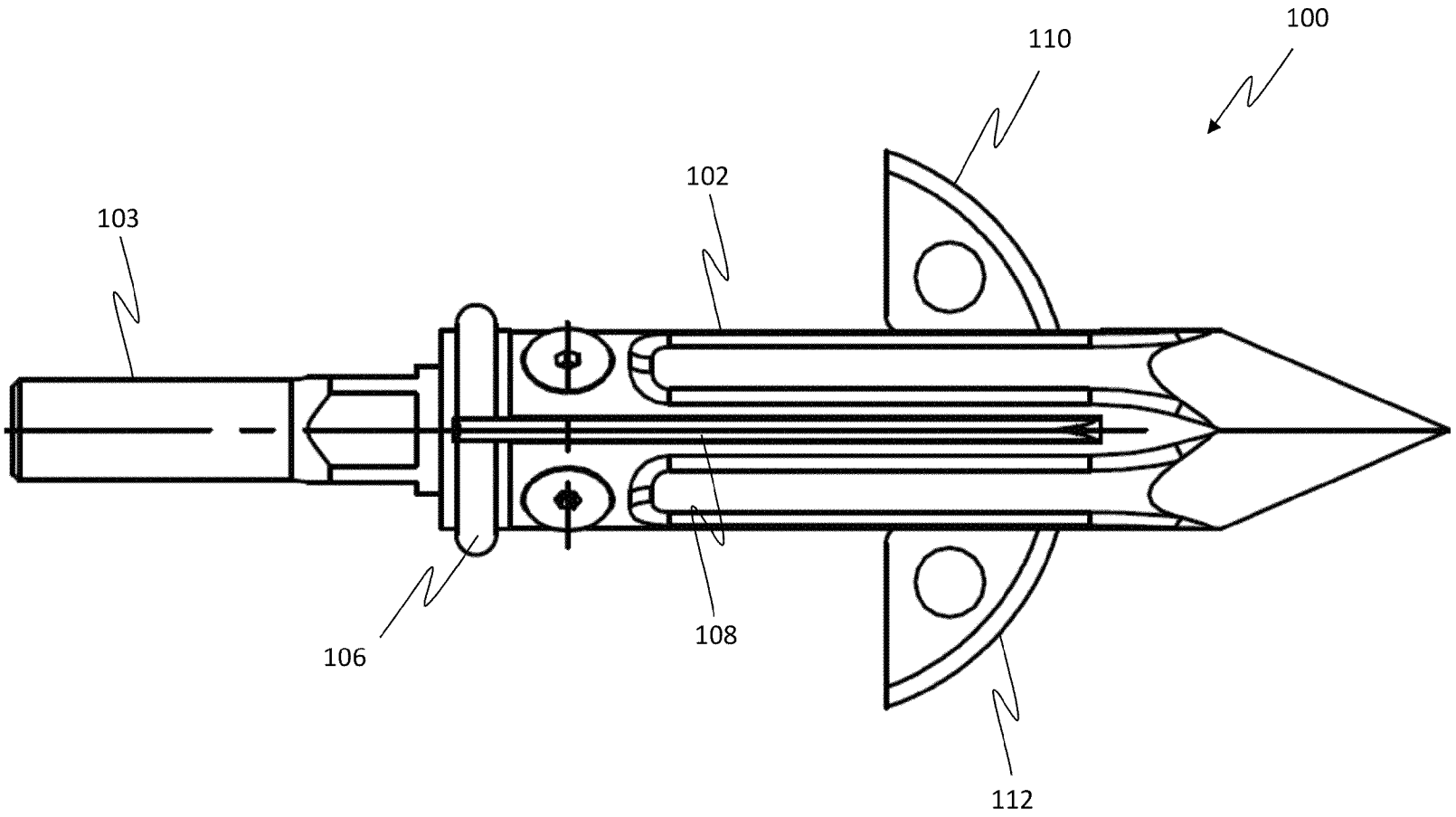
FIG. 1*c* is side view of the broadhead arrowhead of FIG. 1.
Figure 2A:
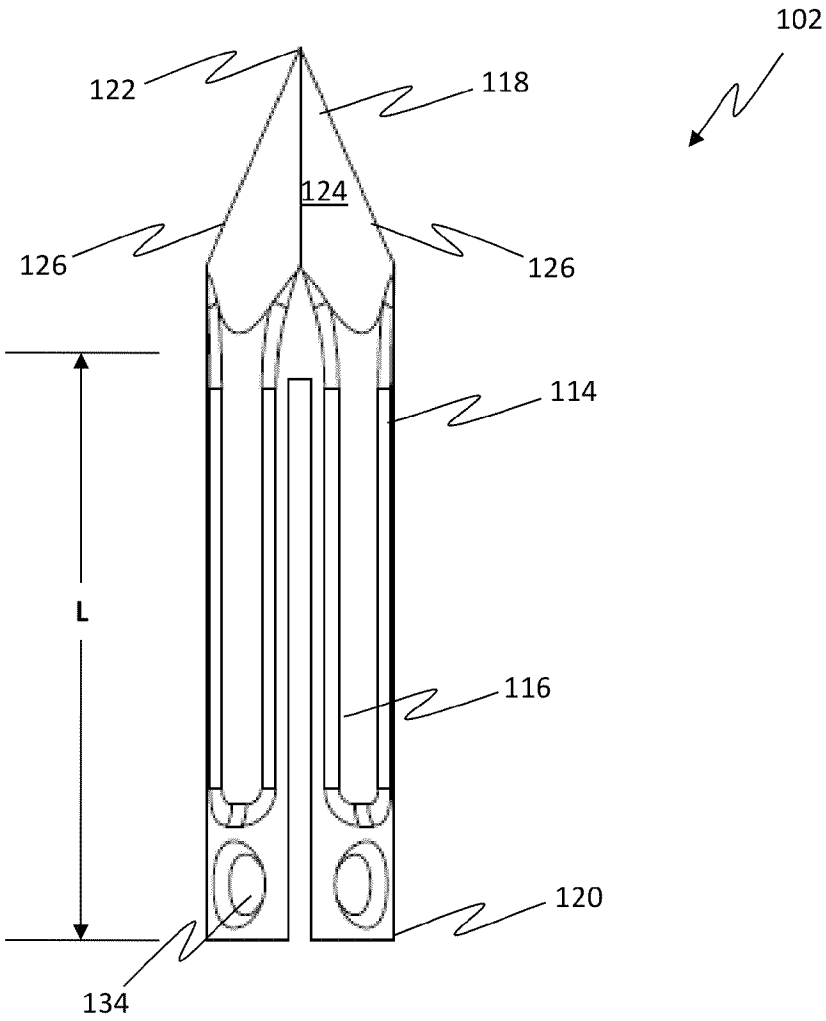
FIG. 2*a* is a side view of the broadhead body of the broadhead arrowhead of FIG. 1.
Figure 2B:
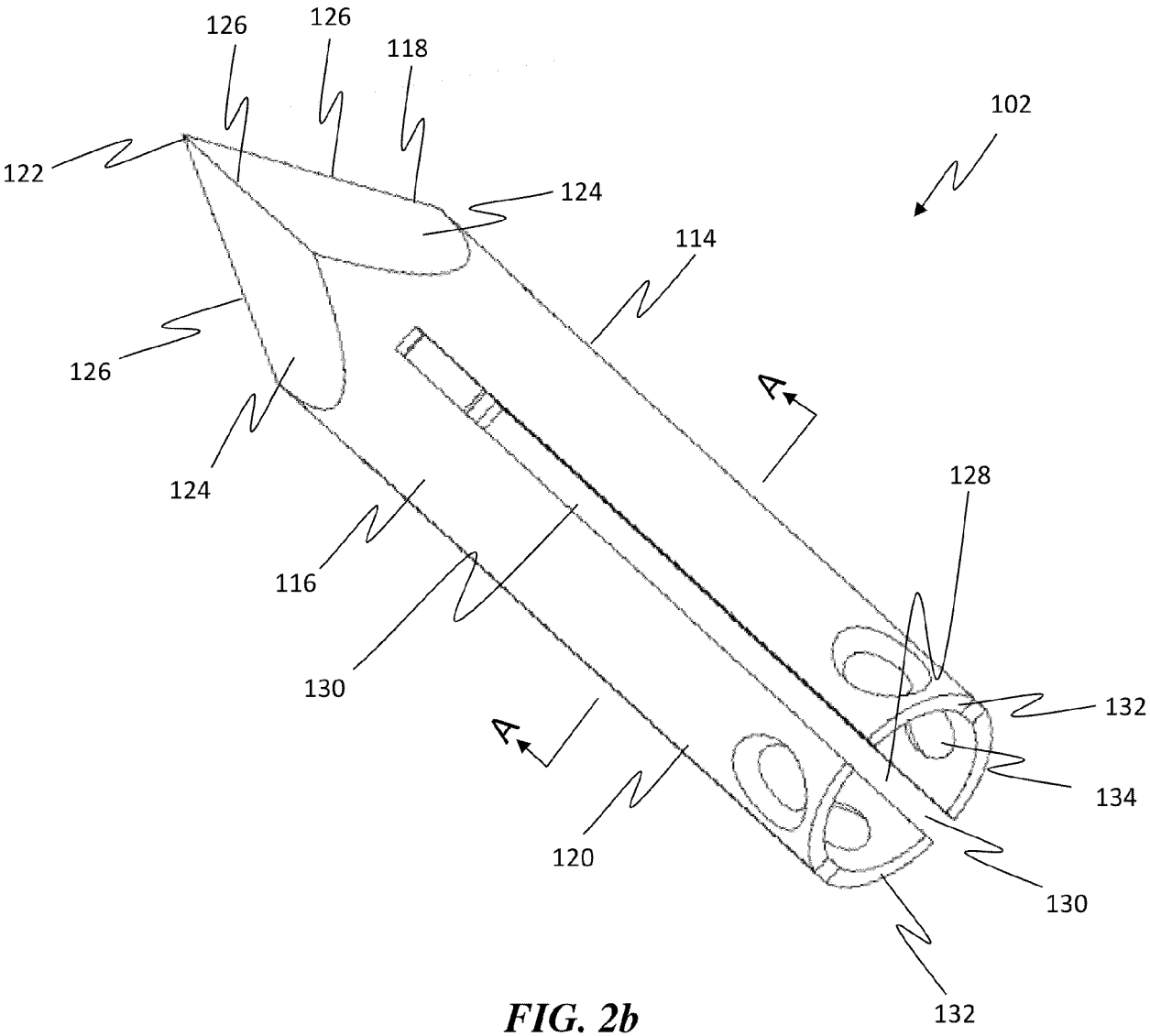
FIG. 2*b* is an isometric view of the broadhead body of the broadhead arrowhead of FIG. 1.
Figure 2C:
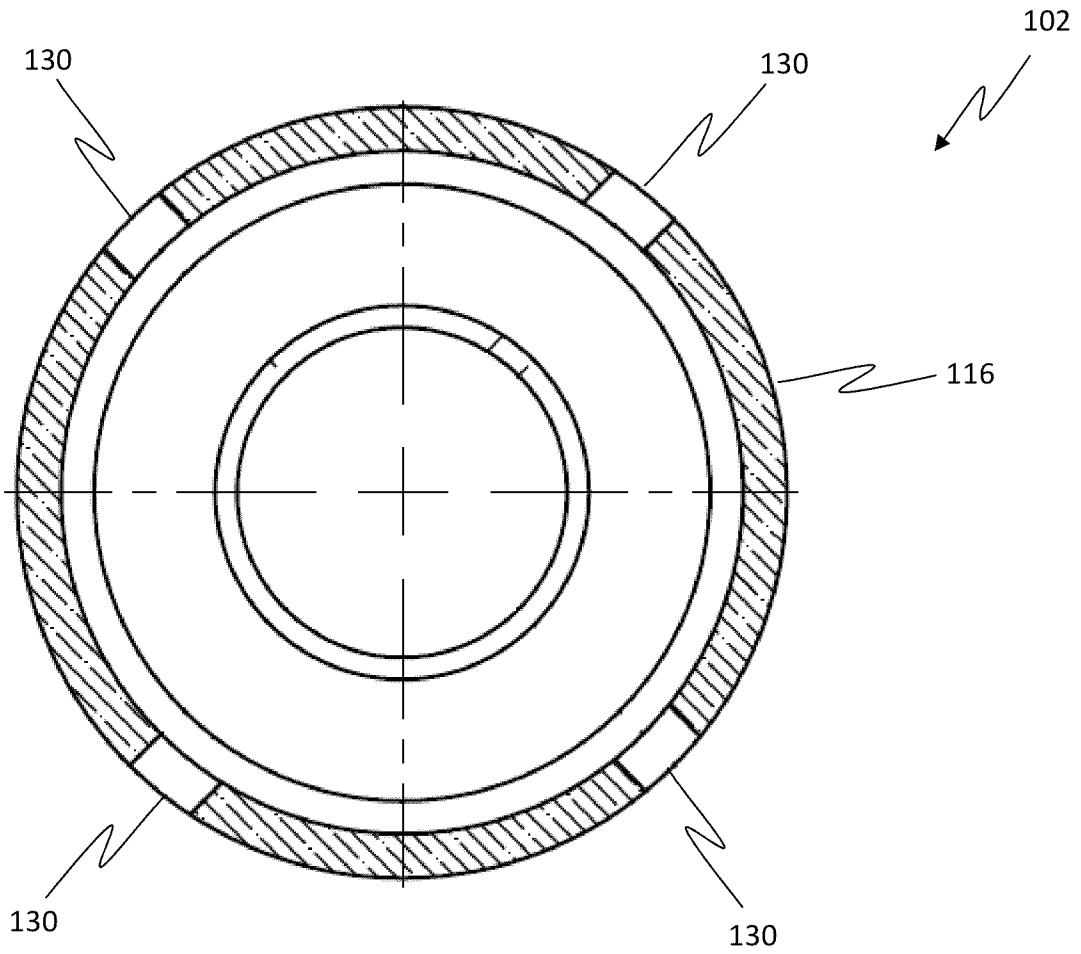
FIG. 2*c* is a bottom up sectional view of the broadhead body of the broadhead arrowhead of FIG. 1.

In accordance with the present invention, referring to FIG. 1*a*, FIG. 1*b* and FIG. 1*c* one embodiment of an improved mechanical broadhead arrowhead 100 having rear deploying blades is provided and includes a broadhead body 102, a broadhead base 104, a deployment O-Ring 106, a plurality of deployable blades 108, a first minor blade 110 and a second minor blade 112. Referring to FIG. 2*a*, FIG. 2*b* and FIG. 2*c*, the broadhead body 102 includes a body structure 114 having a body wall 116 which extends between a body structure tip 118 and a body structure base 120. The body structure 114 is substantially cylindrical in shape with the exception of the body structure tip 118 which is configured to terminate in a point 122. In the embodiment shown, the body structure tip 118 includes four (4) beveled surfaces 124 each of which is substantially perpendicular (in the vertical plane) to the adjacent beveled surface 124 to form four (4) right angles surfaces 126. These right angle surfaces 126 may be sharpened to assist cutting the structure of an object and facilitate entry of the broadhead into the object. The body structure 114 is substantially hollow such that the body wall 116 defines a body cavity 128 which is sized and shaped to movably contain a portion of the first cutting blade 106, second cutting blade 108, first minor blade 110 and second minor blade 112.

Figure 3B:
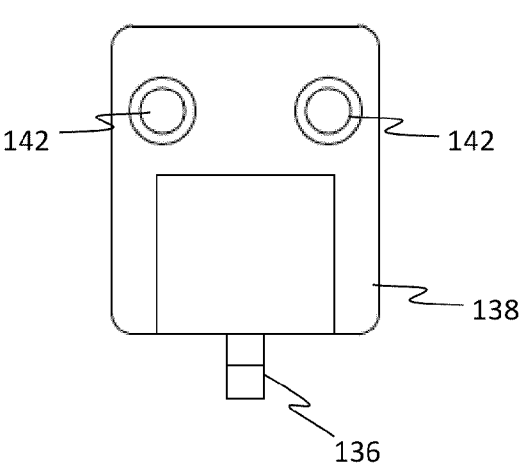
FIG. 3*b* is a rear view of a first minor blade of the broadhead arrowhead of FIG. 1.
Figure 3A:
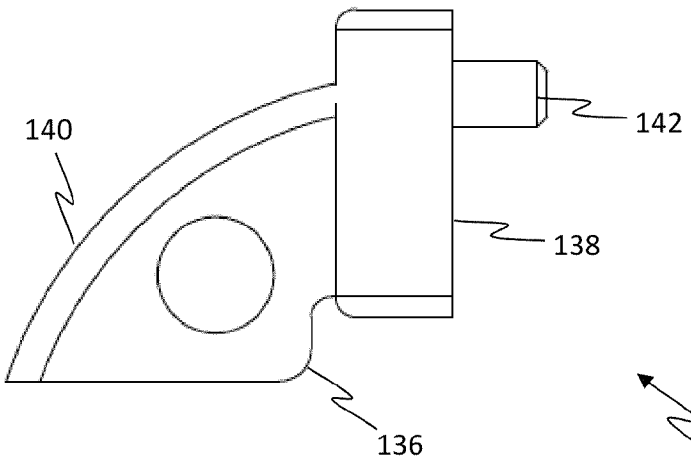
FIG. 3*a* is a side view of a first minor blade of the broadhead arrowhead of FIG. 1.
Figure 3C:
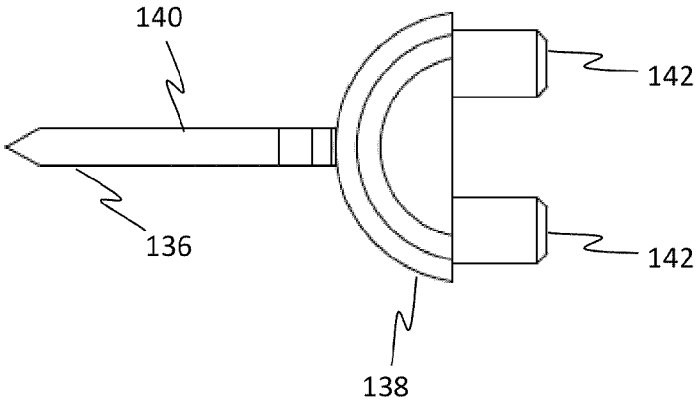
FIG. 3*c* is a top down side view of a first minor blade of the broadhead arrowhead of FIG. 1.
Figure 3E:
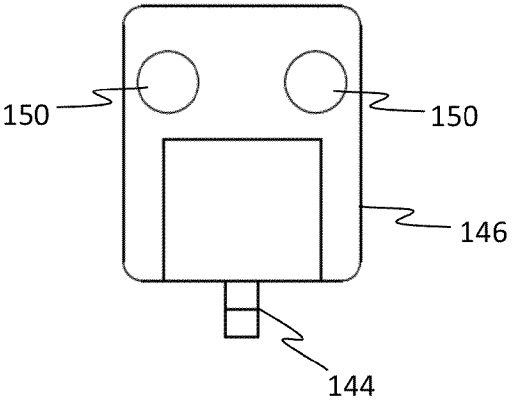
FIG. 3*e* is a rear view of a second minor blade of the broadhead arrowhead of FIG. 1.
Figure 3D:
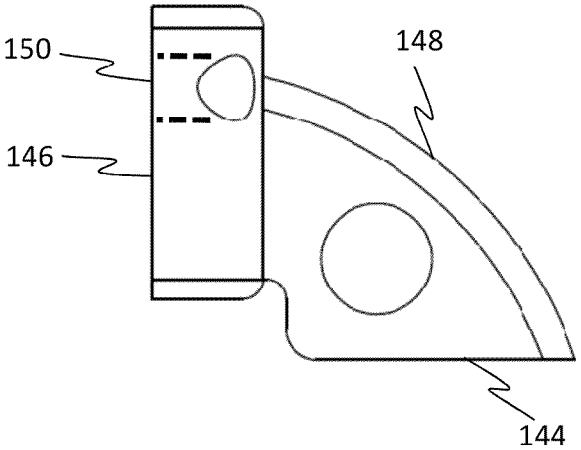
FIG. 3*d* is a side view of a second minor blade of the broadhead arrowhead of FIG. 1.
Figure 3F:
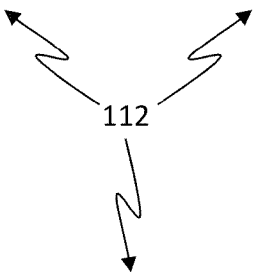
FIG. 3*f* is a top down side view of a second minor blade of the broadhead arrowhead of FIG. 1.
Figure 3F:
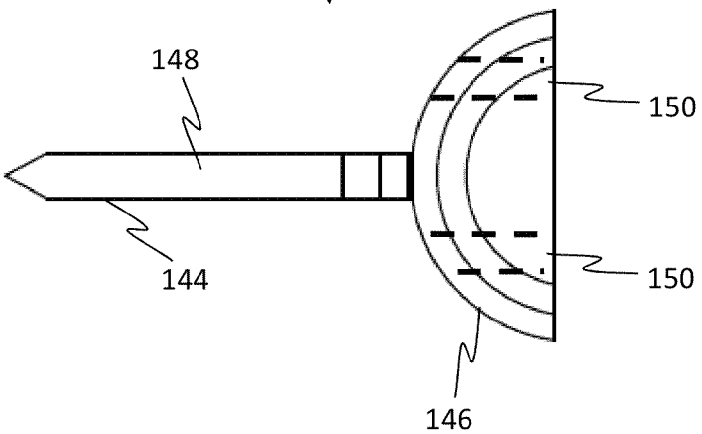
Figure 4A:
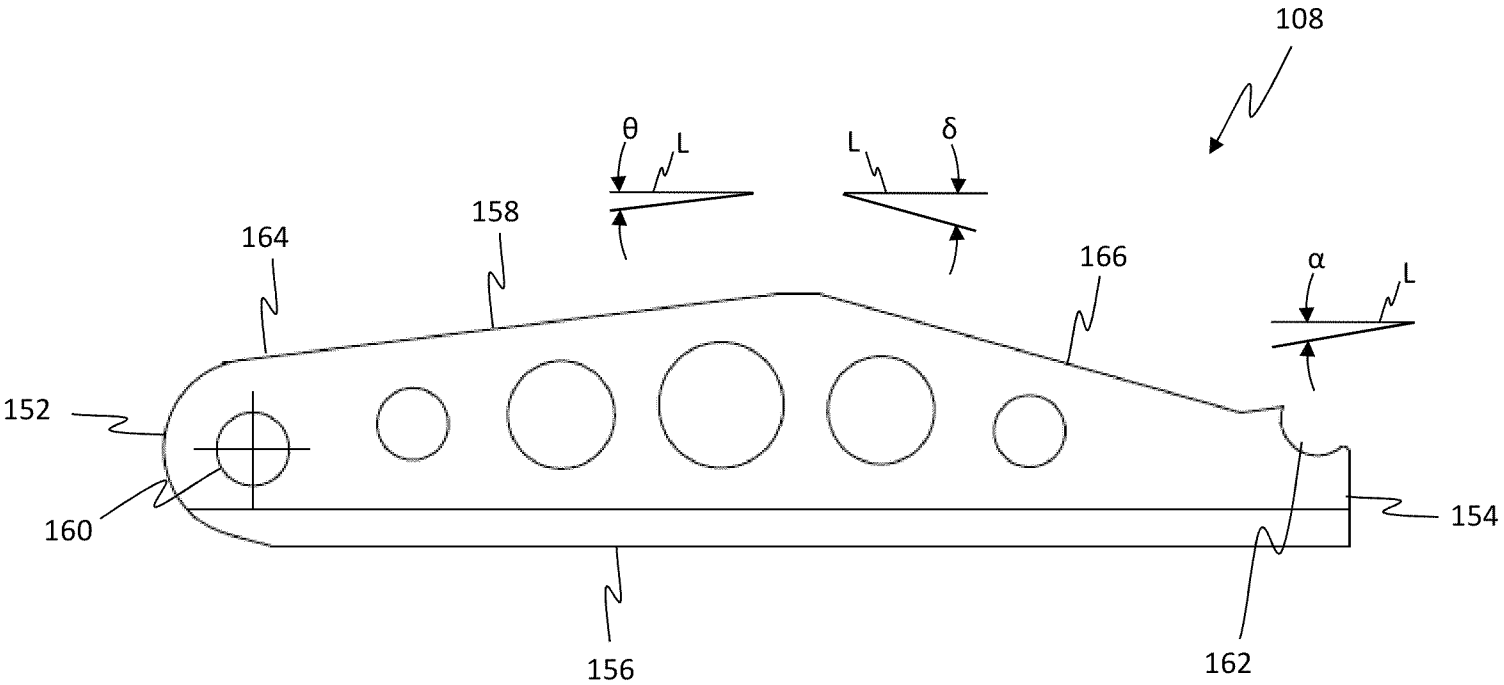
FIG. 4*a* is a side view of a deployable blade of the broadhead arrowhead of FIG. 1.
Figure 4C:
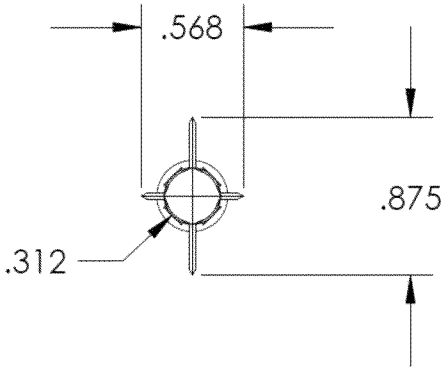
FIG. 4*c* is a top down view of the broadhead arrowhead of FIG. 1 in its non-deployed configuration.
Figure 4D:
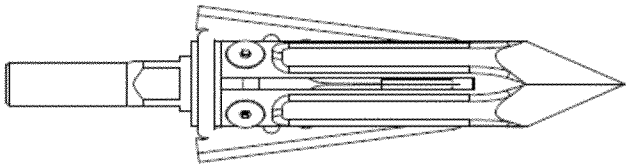
FIG. 4*d* is a side view of the broadhead arrowhead of FIG. 1 in its non-deployed configuration.
Figure 4B:
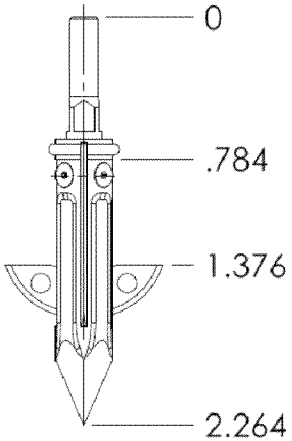
FIG. 4*b* is a side view of a the broadhead arrowhead of FIG. 1 in its non-deployed configuration.
Figure 4F:
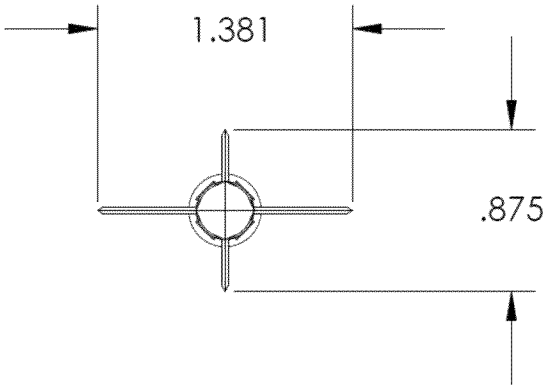
FIG. 4*f* is a top down view of the broadhead arrowhead of FIG. 1 in its deployed configuration.
Figure 4G:
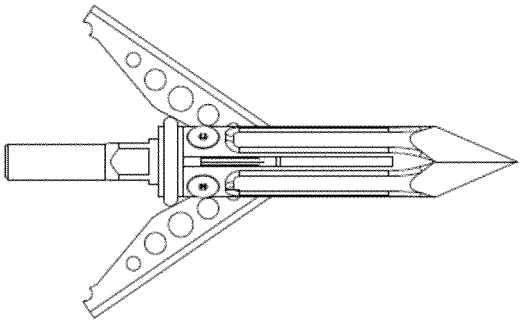
FIG. 4*g* is a side view of the broadhead arrowhead of FIG. 1 in its deployed configuration.
Figure 4E:
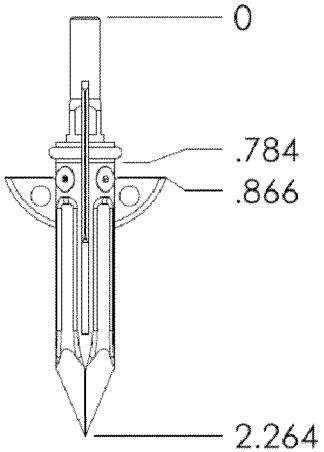
FIG. 4*e* is a side view of the broadhead arrowhead of FIG. 1 in its deployed configuration.
Figure 4I:
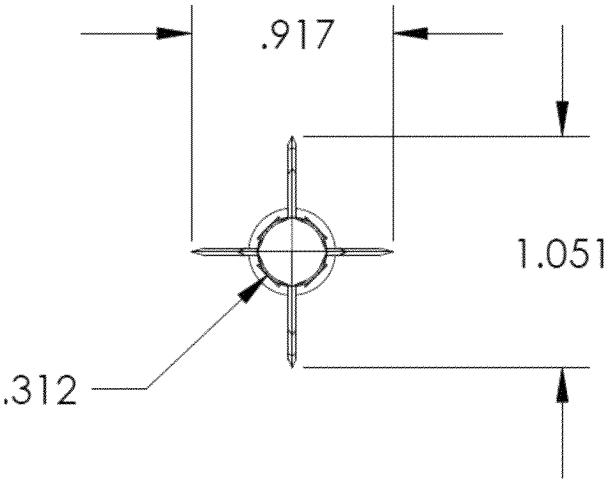
FIG. 4*i* is a top down view of the broadhead arrowhead in accordance with an additional embodiment in its non-deployed configuration.
Figure 4J:
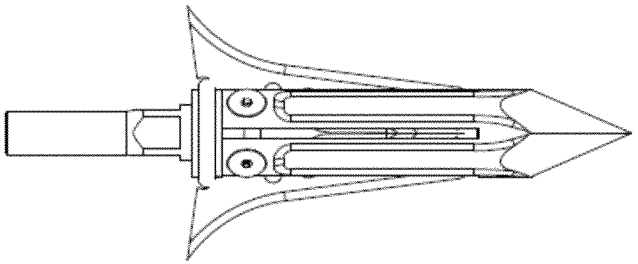
FIG. 4*j* is a side view of the broadhead arrowhead in accordance with an additional embodiment its non-deployed configuration.
Figure 4H:
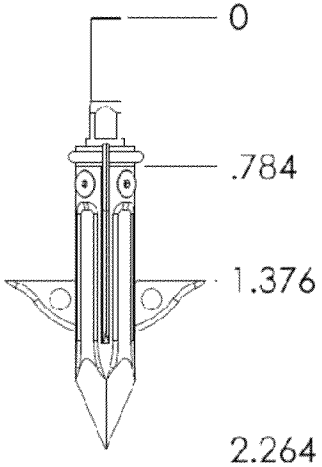
FIG. 4*h* is a side view of the broadhead arrowhead in accordance with an additional embodiment in its non-deployed configuration.
Figure 4L:
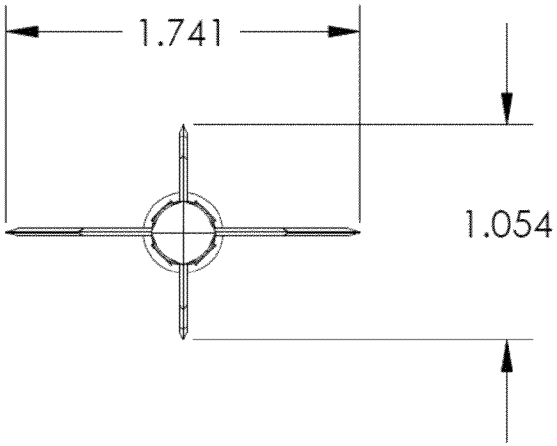
FIG. 4*l* is a top down view of the broadhead arrowhead in accordance with an additional embodiment in its deployed configuration.
Figure 4M:
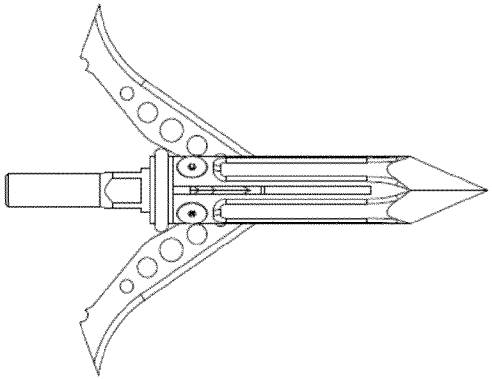
FIG. 4*m* is a side view of the broadhead arrowhead in accordance with an additional embodiment its deployed configuration.
Figure 4K:
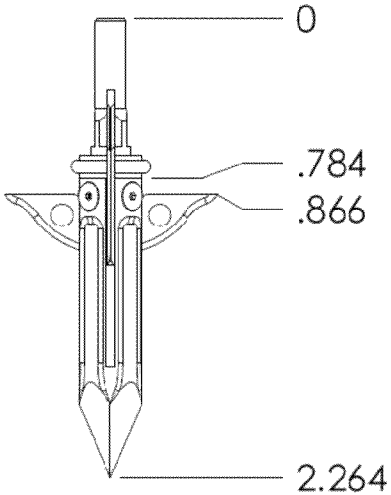
FIG. 4*k* is a side view of the broadhead arrowhead in accordance with an additional embodiment in its deployed configuration.
Figure 4N:
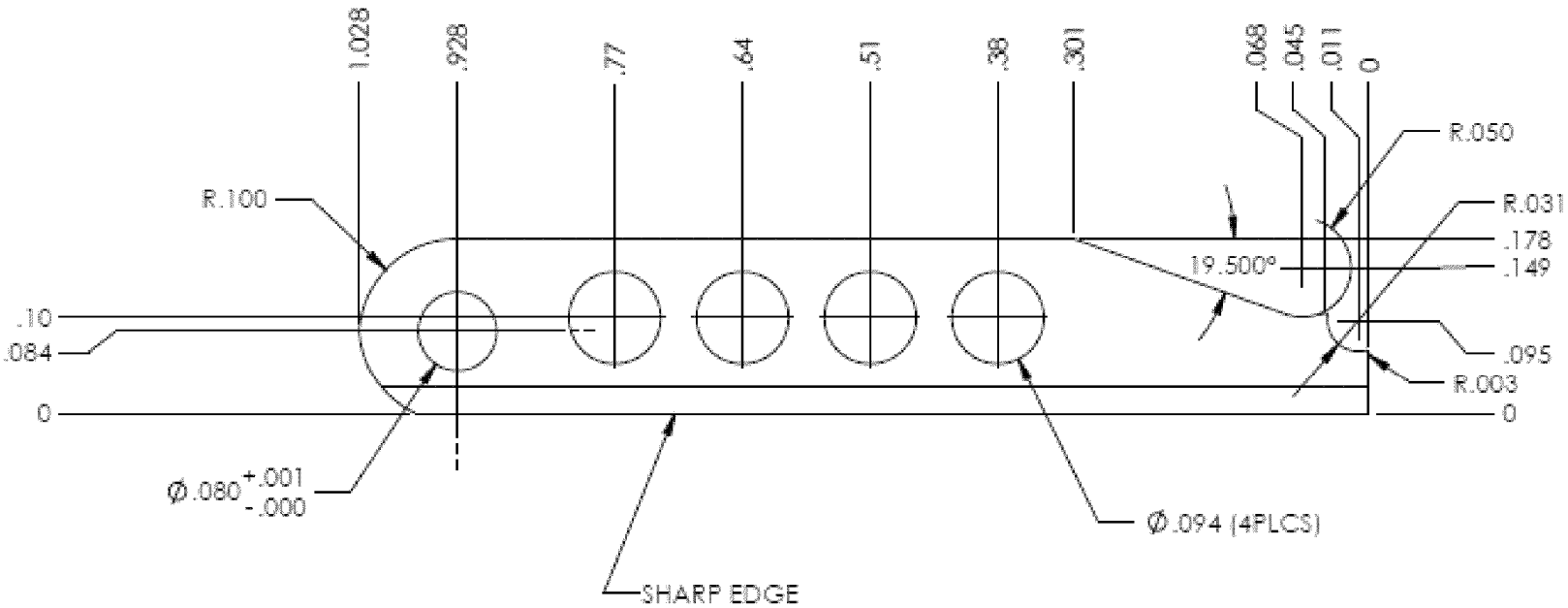
FIG. 4*n* is a side view of a deployable blade of the broadhead arrowhead of FIG. 1.
Figure 4P:
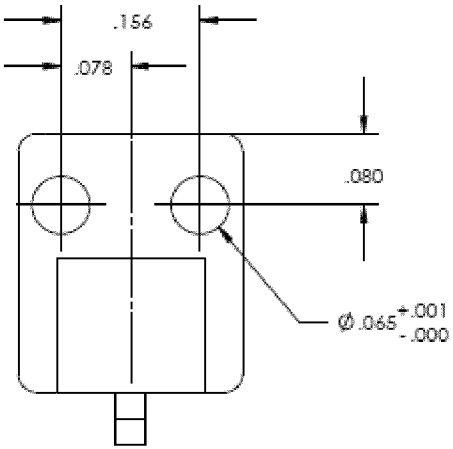
FIG. 4*p* is a rear view of a first minor blade of the broadhead arrowhead of FIG. 1.
Figure 4Q:
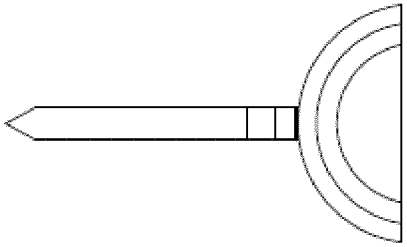
FIG. 4*q* is a top down view of a first minor blade of the broadhead arrowhead of FIG. 1.
Figure 4O:
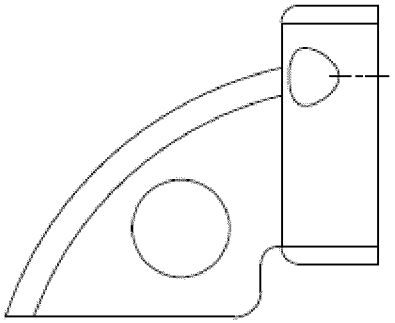
FIG. 4*o* is a side view of a first minor blade of the broadhead arrowhead of FIG. 1.
Figure 4S:
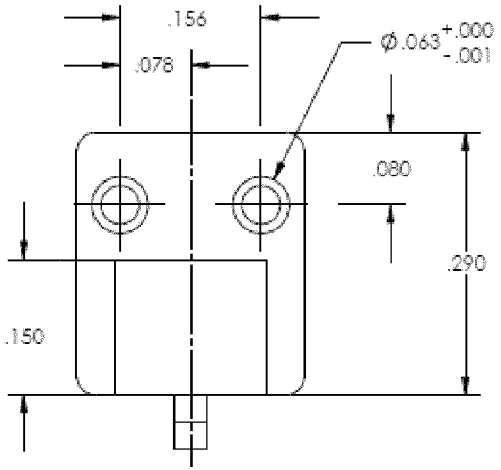
FIG. 4*s* is a side view of a second minor blade of the broadhead arrowhead of FIG. 1.
Figure 4T:
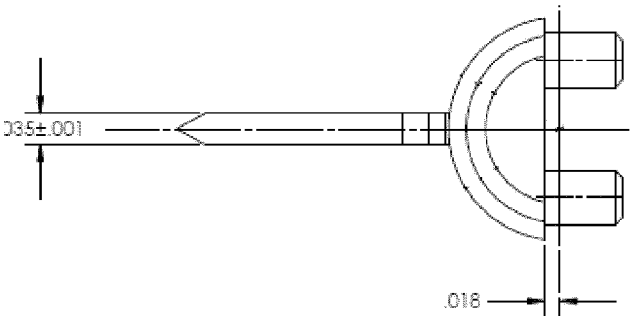
FIG. 4*t* is a side view of a second minor blade of the broadhead arrowhead of FIG. 1.
Figure 4R:
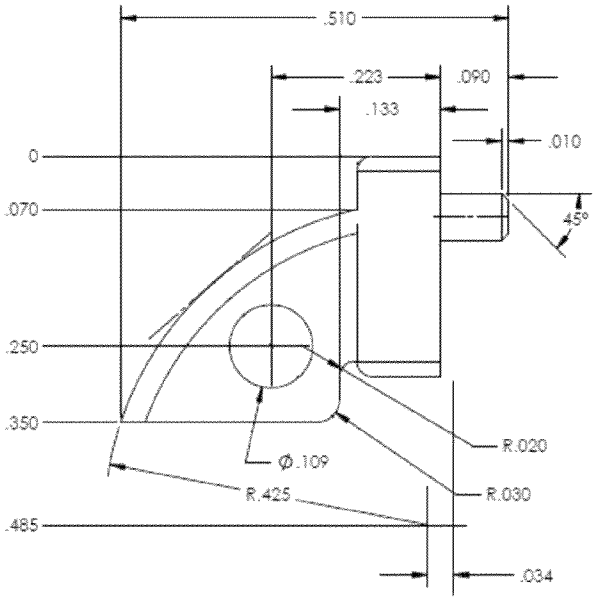
FIG. 4*r* is a side view of a second minor blade of the broadhead arrowhead of FIG. 1.
Figure 4U:
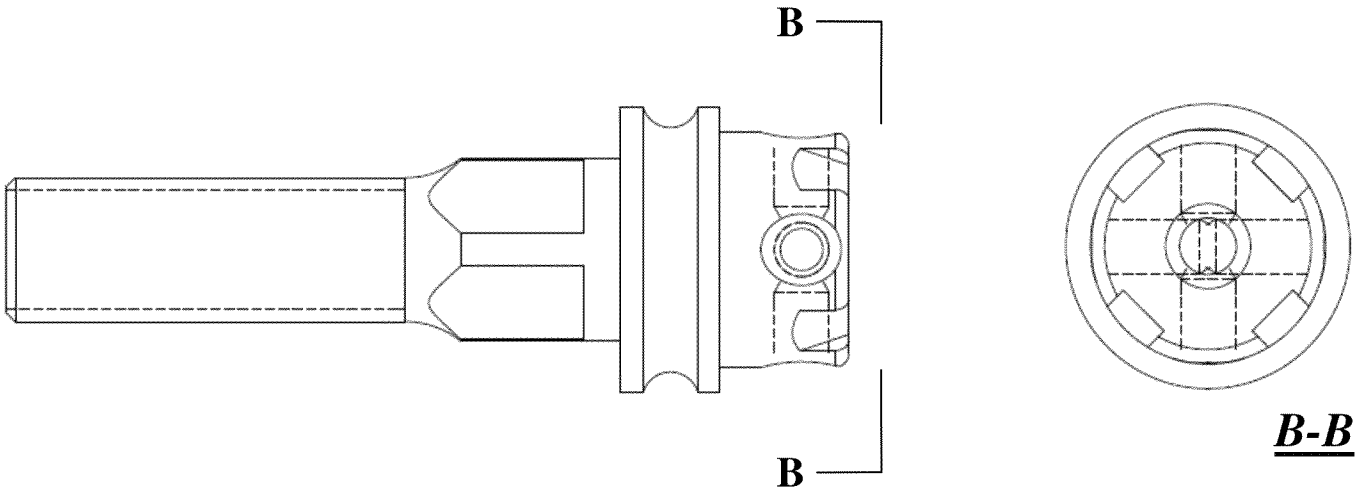
FIG. 4*u* is a side view and a top down view of a broadhead base of the broadhead arrowhead of FIG. 1.

The body wall 116 includes four (4) vertical slots 130 which run (at least partially) the length L of the body wall 116 such that at least a portion of the body wall 116 is divided into four (4) fin structures 132. The vertical slots 130 are located along the body wall 116 such that each of the vertical slots 130 is located on the opposite side of the body wall 116 to one of the vertical slots 130. It should be appreciated that the vertical slots 130 may have a width of 0.035 inches±0.002 inches. Additionally, the body wall 116 includes a plurality of body fastening holes 134 for securely associating the broadhead body 102 to the broadhead base 104. Additionally, it should be appreciated that that the broadhead base 104 may include a threaded surface 103 for threadingly and securingly connecting to the shaft of an arrow. This threaded surface may be an external threaded surface 103 (as shown in FIG. 1*a* and FIG. 1*b*) or it may be internal to the broadhead base 104. Referring to FIG. 3*a*, FIG. 3*b* and FIG. 3*c*, first minor blade 110 is shown and includes a blade portion 136 and a blade base 138. The blade portion 136 includes a curved surface 140 that may or may not be sharpened as desired. The blade base 138 includes at least one base protruding member 142 (in this embodiment there are two base protruding members 142) which extends away from the blade base 138 in a direction opposite the blade portion 136. Referring to FIG. 3*d*, FIG. 3*e* and FIG. 3*f*, second minor blade 112 is shown and includes a blade portion 144 and a blade base 146. The blade portion 144 includes a curved surface 148 that may or may not be sharpened as desired. The blade base 146 includes at least one base cavity 150 which is sized and shaped to contain at least a portion of base protruding members 142 when the first minor blade 110 and second minor blade 112 are associated with each other. In this embodiment there are two base cavities 150 to receive and contain at least a portion of the two base protruding members 142 as discussed further hereinafter.

Referring to FIG. 4, a deployable blade 108 is shown and includes a first end 152, a second end 154, a blade edge 156 and a rear edge 158. The deployable blade 108 includes an interface hole (or cavity) 160 and an O-Ring cutout 162, wherein the interface hole 160 is located proximate to the first end 152 and the O-Ring cutout 162 is located on the second end 154 and is integral to the rear edge 158. The O-Ring cutout 162 is shown as being semi-circular in shape, but may be any shape suitable to the desired end purpose. As discussed further hereinafter, it should be appreciated that interface hole 160 is sized and shaped to contain one of the base protruding members 142 and that the first end 152 of the deployable blade 108 is rounded. It should be further appreciated that the blade edge 156 (all or a portion) may be sharpened or unsharpened and/or may include serrations. The rear edge 158 may angled such that the width of the deployable blade 108 is thinner towards the ends 152, 154 and wider towards the center of the deployable blade 108. For example, as shown in FIG. 4 the rear edge includes an upper edge 164, a lower edge 166 and the O-Ring cutout 162, where the upper edge 164 is angled at an angle θ from a line L tangent to the plane of the blade edge 156 and the lower edge 166 is angled at an angle δ from a line L tangent to the plane of the blade edge 156. Additionally, the O-Ring cutout 162 includes a transition edge 168 which is angled at an angle α from a line L tangent to the plane of the blade edge 156. It should be appreciated that although angle θ is shown as being approximately equal to 7°±5°, angle δ is shown as being approximately equal to 16°±5° and angle α is shown as being approximately equal to 8°±5°, angles θ, δ and α may be any angle desired suitable to the desired end purpose.

In addition, it should be appreciated that the improved mechanical broadhead arrowhead 100 and/or its components may be of any size suitable to the desired purpose. Referring to FIGS. 4*b*-4*m*, some sizes for a couple embodiments of the improved mechanical broadhead arrowhead in their deployed and non-deployed configurations are shown, where the dimensions are shown in inches. Additionally, referring to FIGS. 4*n*-4*u*, the sizes of the component parts of one embodiment of the improved mechanical broadhead arrowhead are shown, where the dimensions are shown in inches.

Figure 5A:
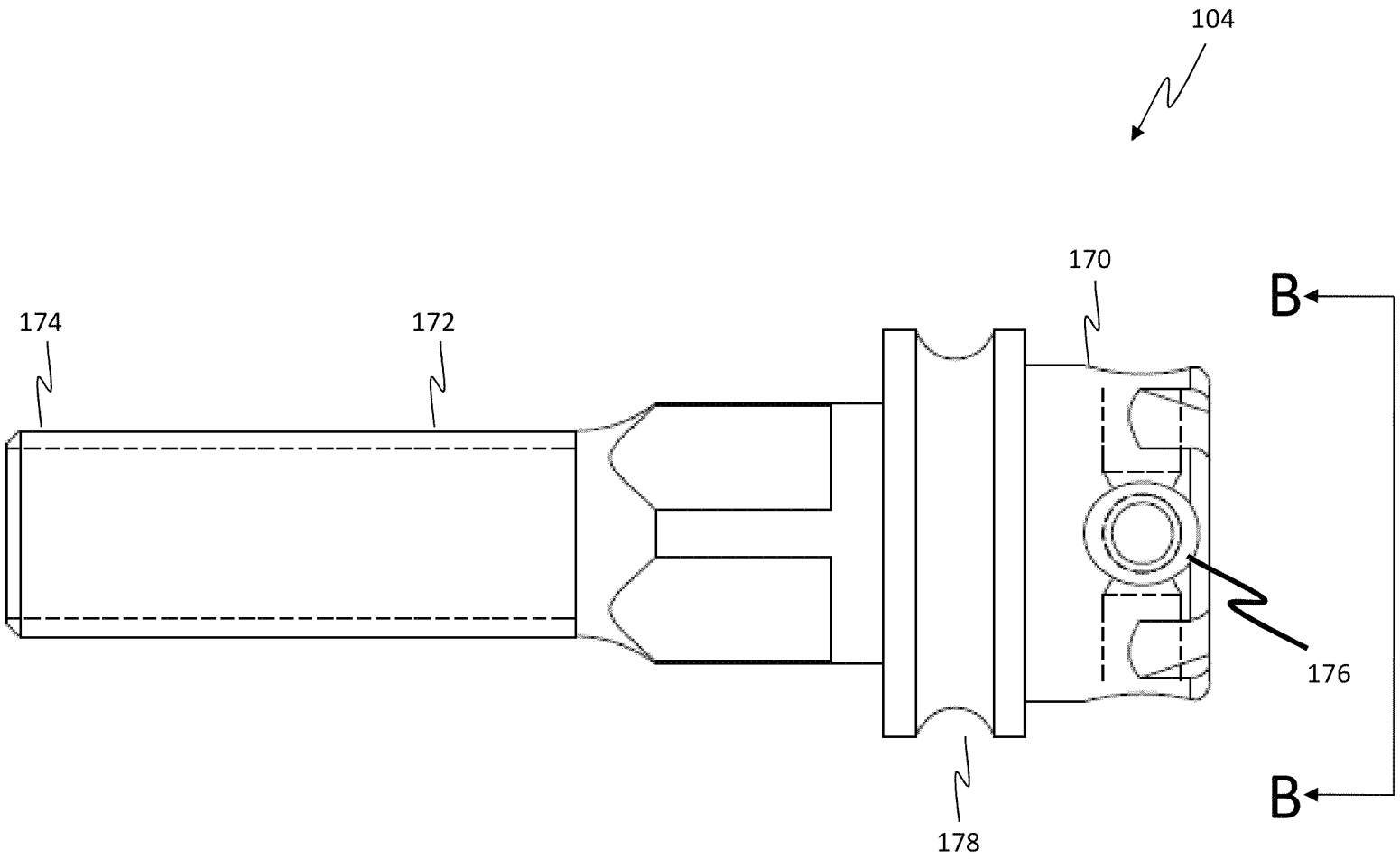
FIG. 5*a* is a side view of a broadhead base of the broadhead arrowhead of FIG. 1.
Figure 5B:
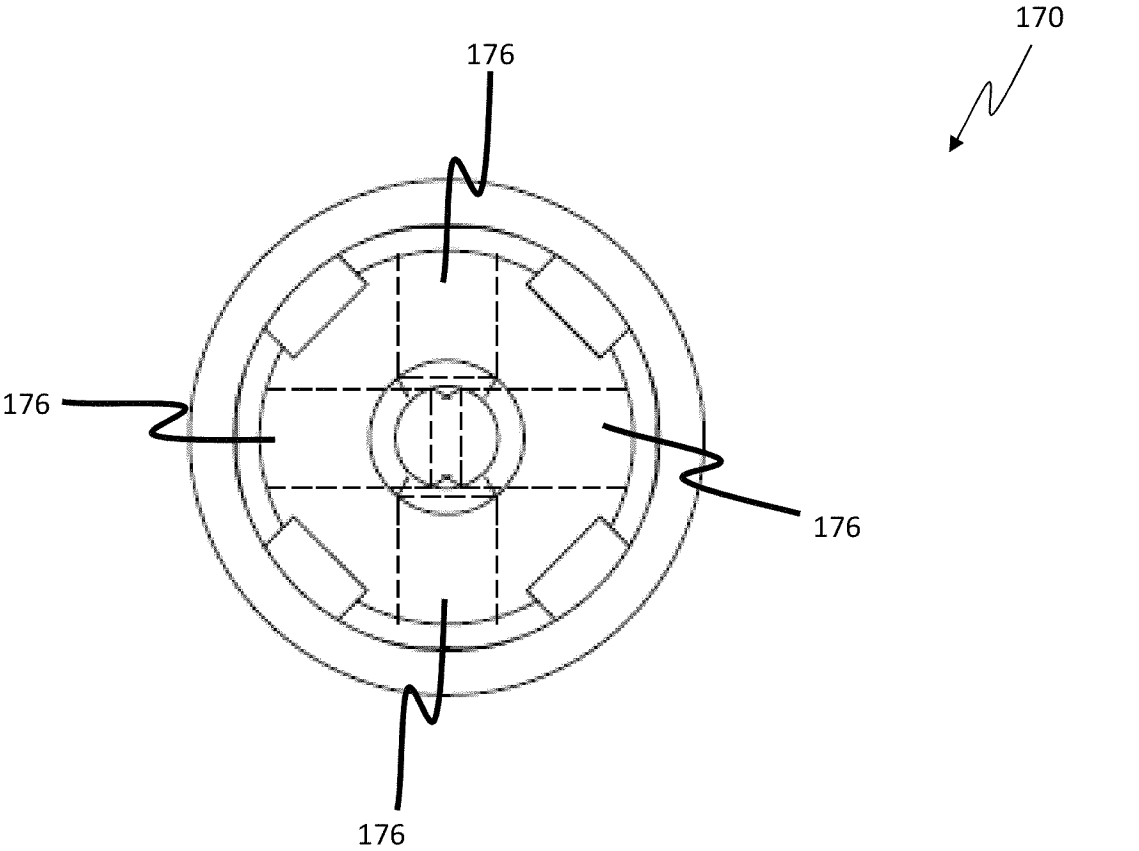
FIG. 5*b* is a top down view of a broadhead base of the broadhead arrowhead of FIG. 1.

Referring to FIG. 5*a* and FIG. 5*b*, the broadhead base 104 is shown and includes a base head 170 and a base stem 172, wherein the base stem 172 includes a threaded portion 174 for securingly associating with an arrow. In accordance with the present invention, the base head 170 is sized and shaped to at least partially fit into body cavity 128 of broadhead body 102, where the base head 170 includes a plurality of mounting cavities 176 which have a threaded inner surface for threadingly and securingly interacting with the threads of a screw. It should be appreciated that the plurality of mounting cavities 176 as located along the circumference of the base head 170 to align up with the body fastening holes 134 when the broadhead body 102 is associated with the broadhead base 104. Additionally, the base head 170 includes an O-Ring channel 178 which extends along the circumference of the base head 170, where the O-Ring channel 178 is sized and shaped to receive and contain O-Ring 106.

Figure 6:
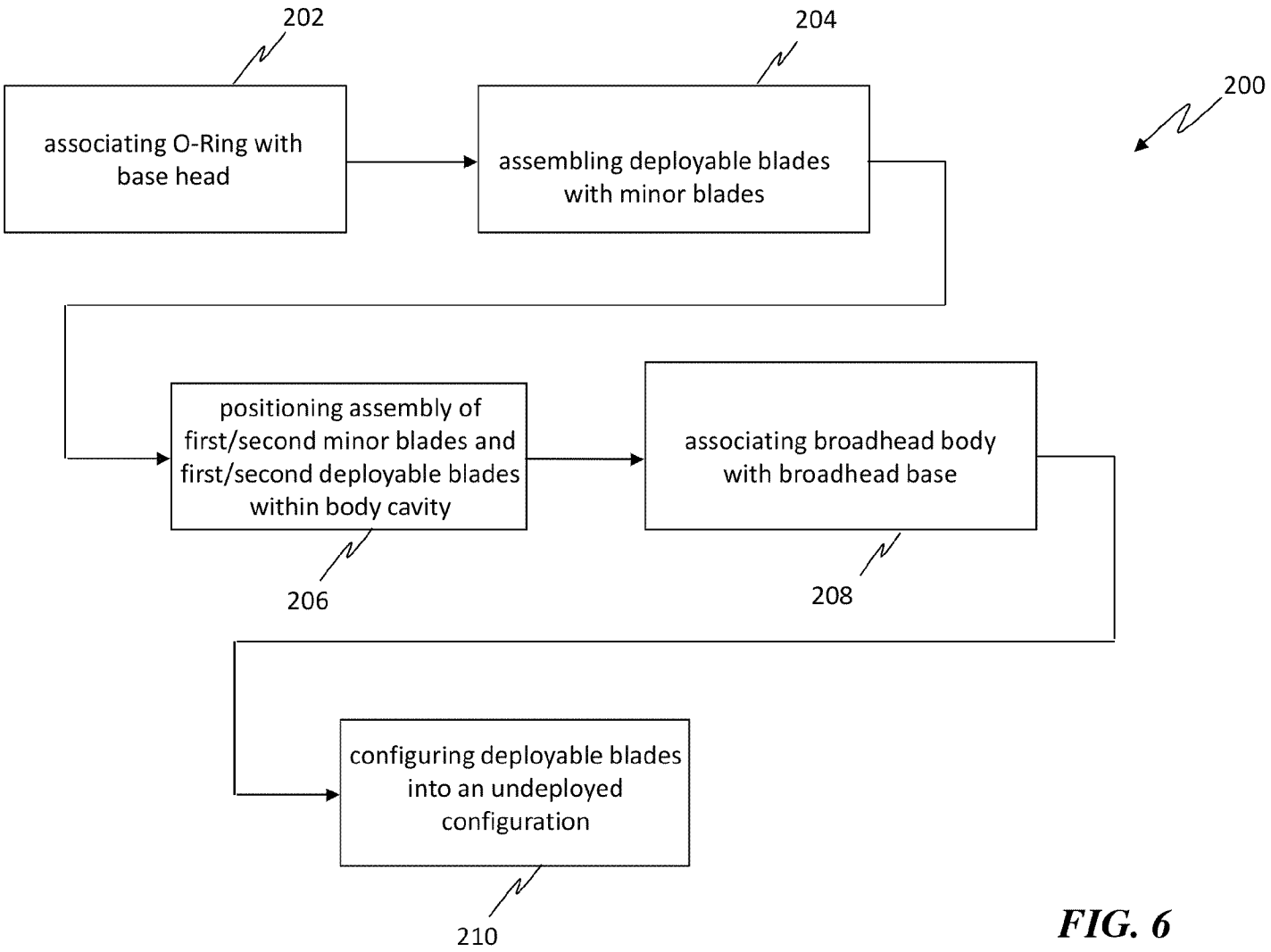
FIG. 6 is an operational block diagram illustrating one embodiment of a method for assembling the broadhead arrowhead of FIG. 1.
Figure 7B:
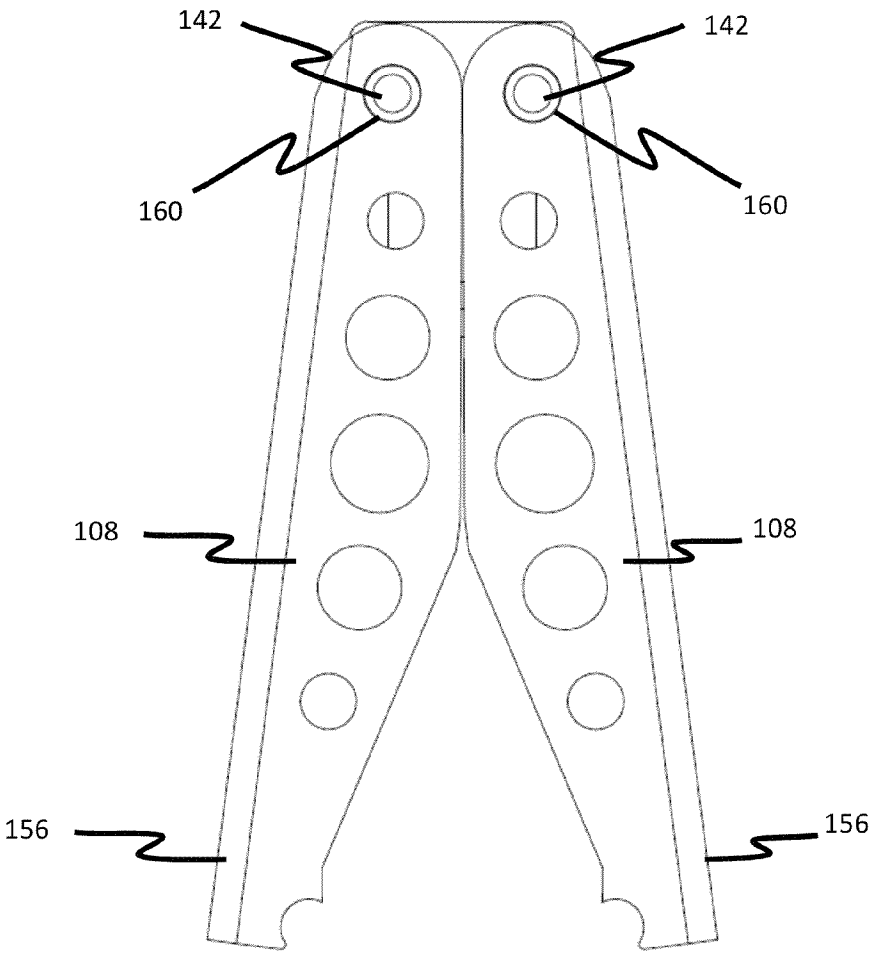
FIG. 7*b* is a front view of both deployable blades of FIG. 4 associated with first minor blade of FIGS. 3*a*-3*c*.
Figure 7A:
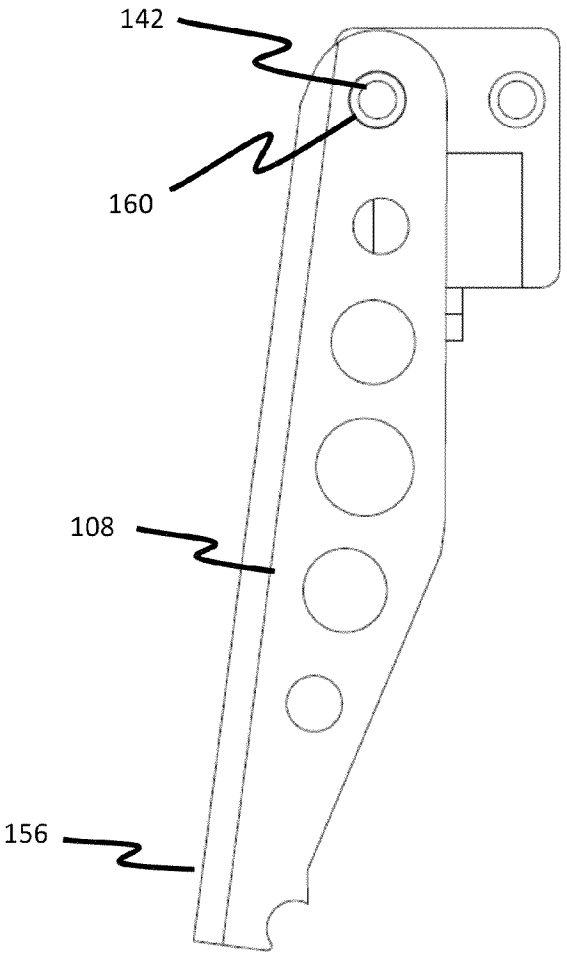
FIG. 7*a* is a front view of one deployable blade of FIG. 4 associated with first minor blade of FIGS. 3*a*-3*c*.
Figure 8B:
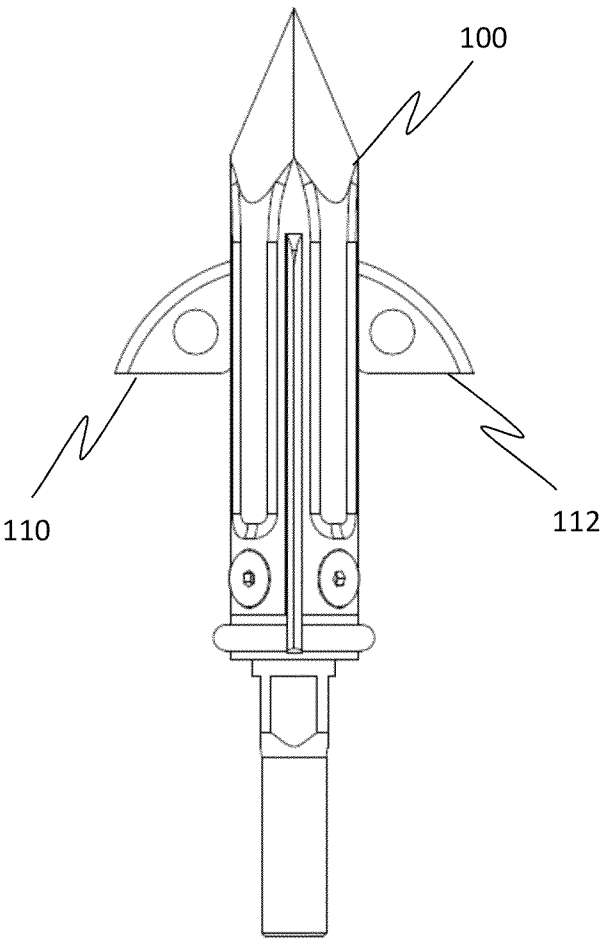
FIG. 8*b* is a side view of the broadhead arrowhead of FIG. 1 with the deployable blades in a non-deployed configuration.
Figure 8A:
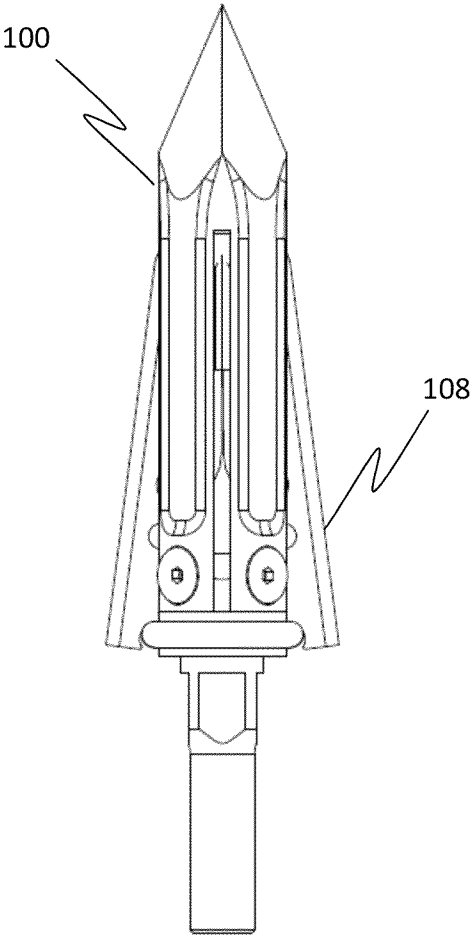
FIG. 8*a* is a side view of the broadhead arrowhead of FIG. 1 with the deployable blades in a non-deployed configuration.
Figure 8D:
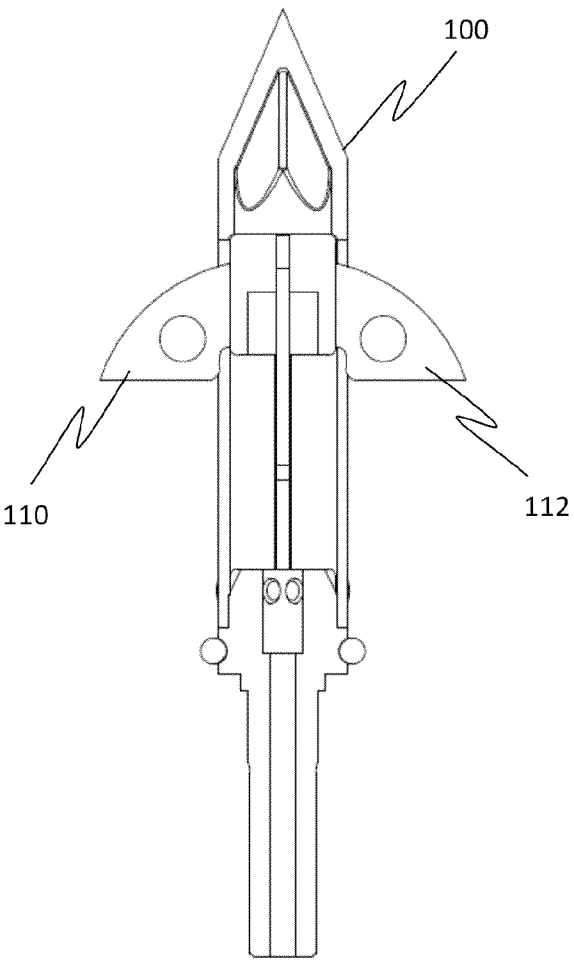
FIG. 8*d* is a sectional side view of the broadhead arrowhead of FIG. 1 with the deployable blades in a non-deployed configuration.
Figure 8C:
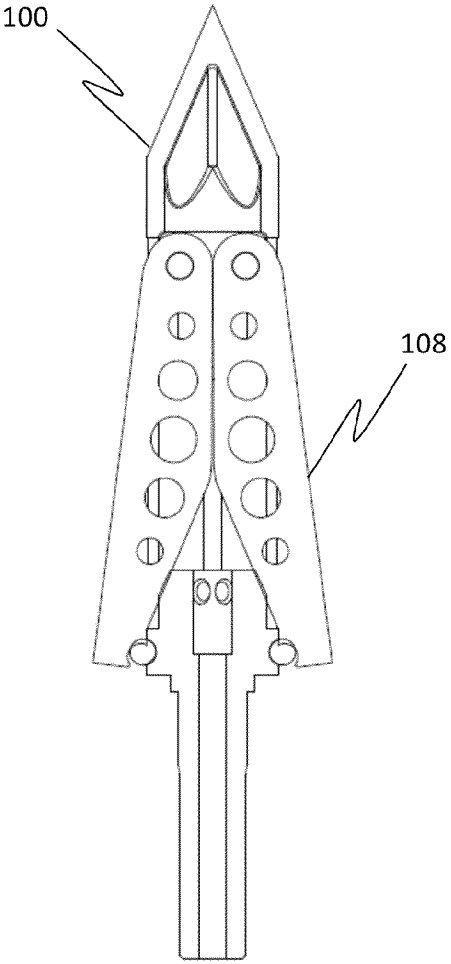
FIG. 8*c* is a sectional side view of the broadhead arrowhead of FIG. 1 with the deployable blades in a non-deployed configuration.
Figure 9B:
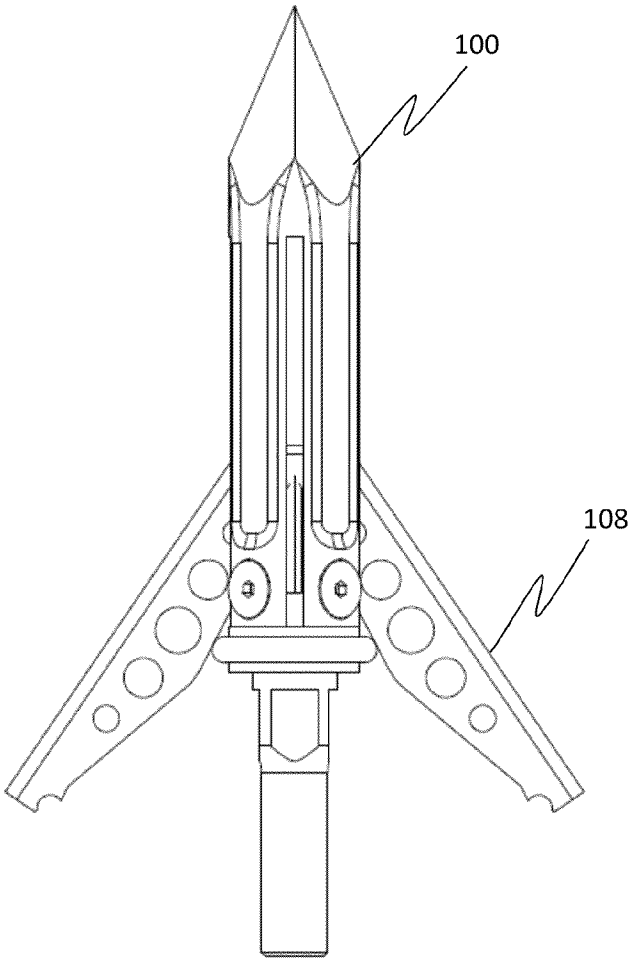
FIG. 9*b* is a side view of the broadhead arrowhead of FIG. 1 with the deployable blades in a deployed configuration.
Figure 9A:
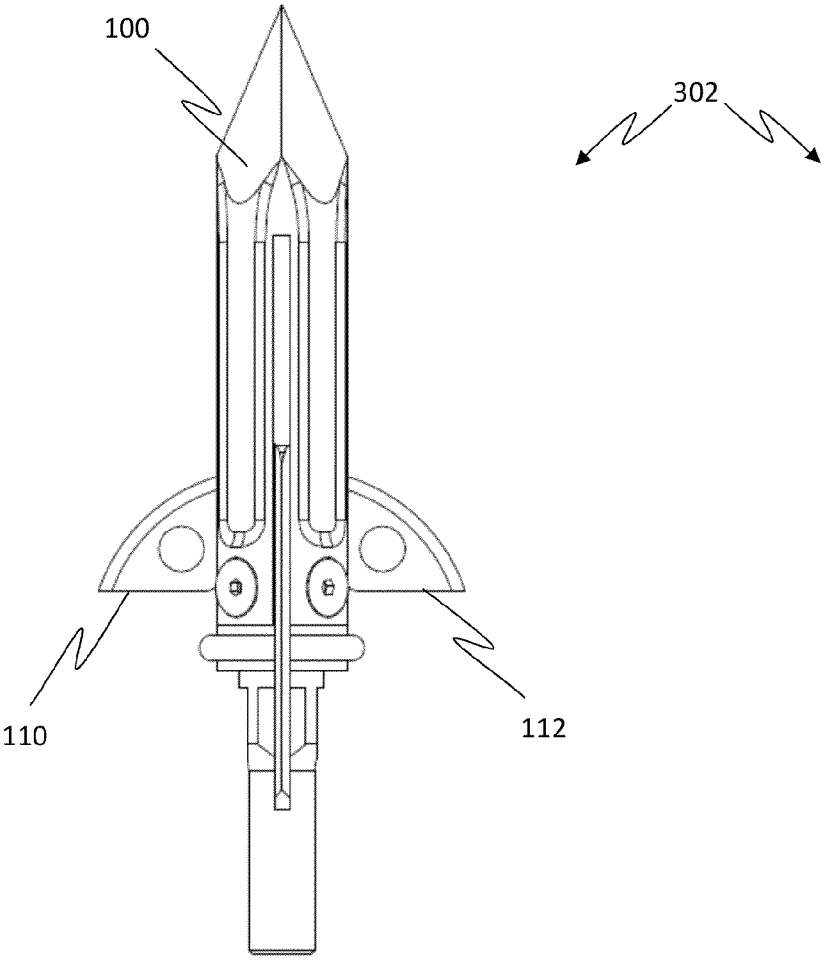
FIG. 9*a* is a side view of the broadhead arrowhead of FIG. 1 with the deployable blades in a deployed configuration.
Figure 9D:
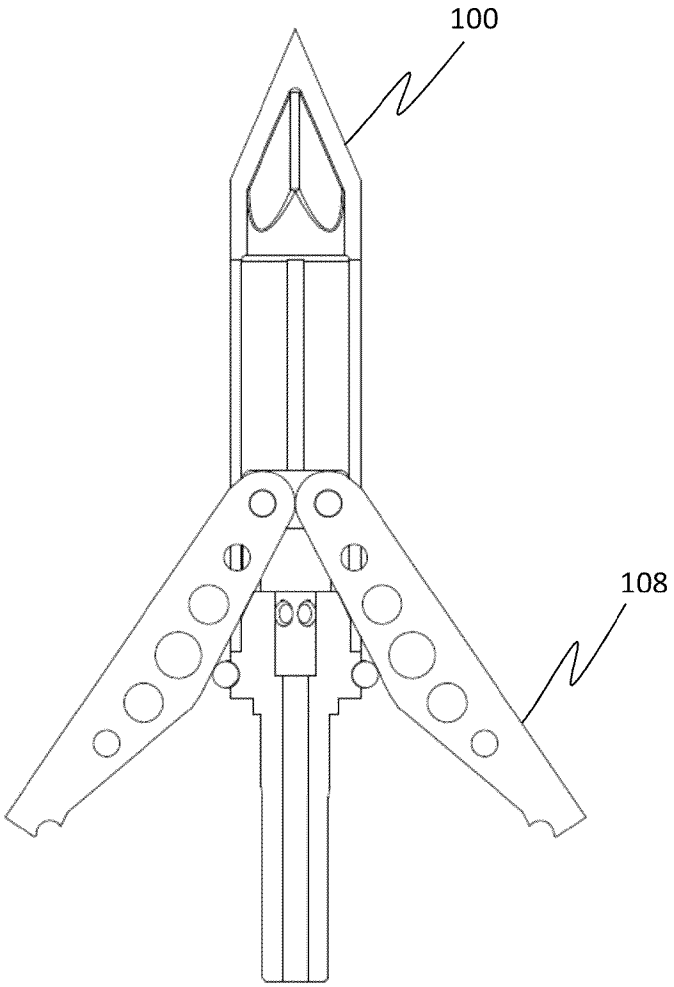
FIG. 9*d* is a sectional side view of the broadhead arrowhead of FIG. 1 with the deployable blades in a deployed configuration.
Figure 9C:
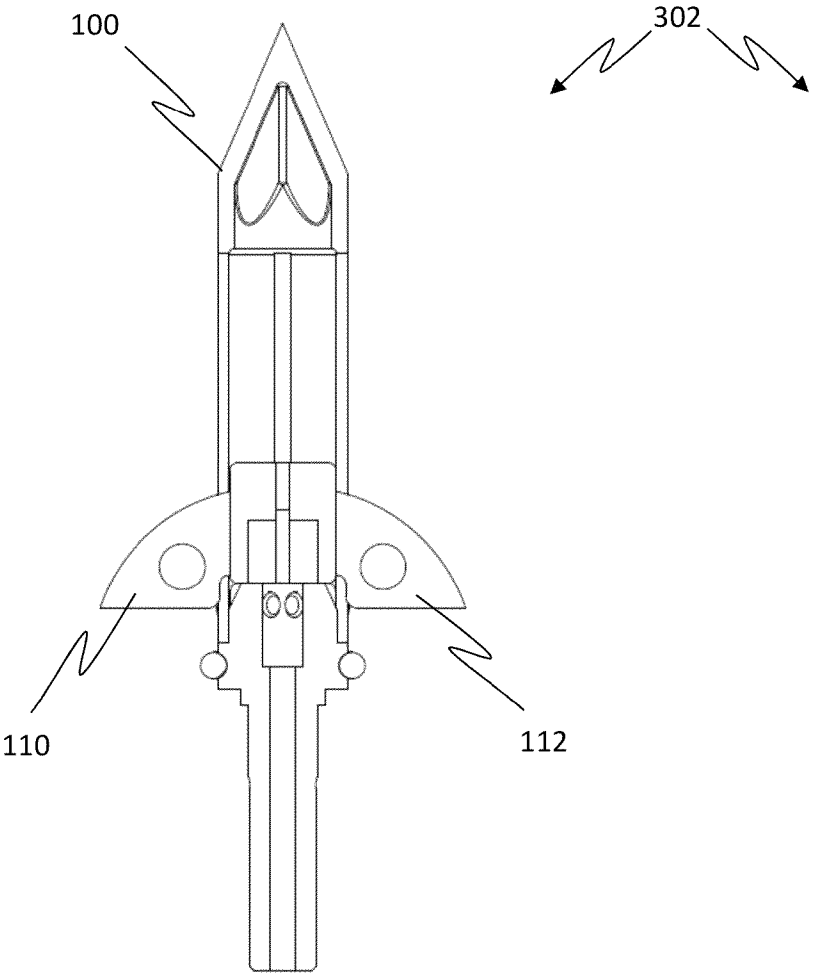
FIG. 9*c* is a sectional side view of the broadhead arrowhead of FIG. 1 with the deployable blades in a deployed configuration.

Referring to FIG. 6, an operational block diagram illustrating one embodiment of a method 200 for assembling the broadhead arrowhead 100 is shown and includes associating the O-Ring 106 with the base head 170 such that the O-Ring 106 is located within O-Ring channel 178, as shown in operational block 202. The deployable blades 108 are assembled by associating the deployable blades 108 with first minor blade 110 and second minor blade 112, as shown in operational block 204. This may be accomplished by associating the first deployable blade 108 with first minor blade 110 by positioning the first base protruding member 142 within interface hole 160 of the first deployable blade 108 such that the blade edge is pointed away from the first minor blade 110, as shown in FIG. 7*a*. Additionally, the second deployable blade 108 is associated with first minor blade 110 by positioning the second base protruding member 142 within interface hole 160 of the second deployable blade 108 such that the blade edge is pointed away from the first minor blade 110, as shown in FIG. 7*b*. The second minor blade 112 is then associated with first minor blade 110 by positioning the first base protruding member 142 within a first base cavity 150 and second base protruding member 142 within a second base cavity 150. Accordingly, the first and second deployable blades are sandwiched in between first minor blade 110 and second minor blade 112. At this point, the first minor blade 110 and second minor blade 112 are each substantially perpendicular to the first and second deployable blades 108.

This assembly of first and second minor blades 110, 112 and first and second deployable blades 108 are then positioned within the body cavity 128, as shown in operational block 206. It should be appreciated that the blade portion 136 is protruding out of a first vertical slot 130, blade portion 144 is protruding out of a second vertical slot 130, first deployable blade 108 blade is protruding out of a third vertical slot 130 and second deployable blade 108 blade is protruding out of a fourth vertical slot 130. It should be appreciated that the blade base assembly 138, 146 is sized and shaped to freely traverse the length L of body cavity 128. The broadhead body 102 is associated with broadhead base 104, as shown in operational block 208. This may be accomplished by positioning the base head 170 within body cavity 128 such that threaded mounting cavities 176 align with body fastening holes 134. One mounting screw is then threadingly associated with each pair of threaded mounting cavities 176 and body fastening holes 134. The deployable blades 108 are configured to be in an undeployed configuration, as shown in operational block 210. This may be accomplished by sliding the first and second minor blades 110, 112 along the length L of the body cavity 128 toward the body structure tip 118 until they stop. The second end 154 of the deployable blades 108 are then pushed inward toward the deployment O-Ring 106 until the deployment O-Ring 106 is at least partially positioned within O-Ring cutout 162.

Figures 10A, 10B, 10C:
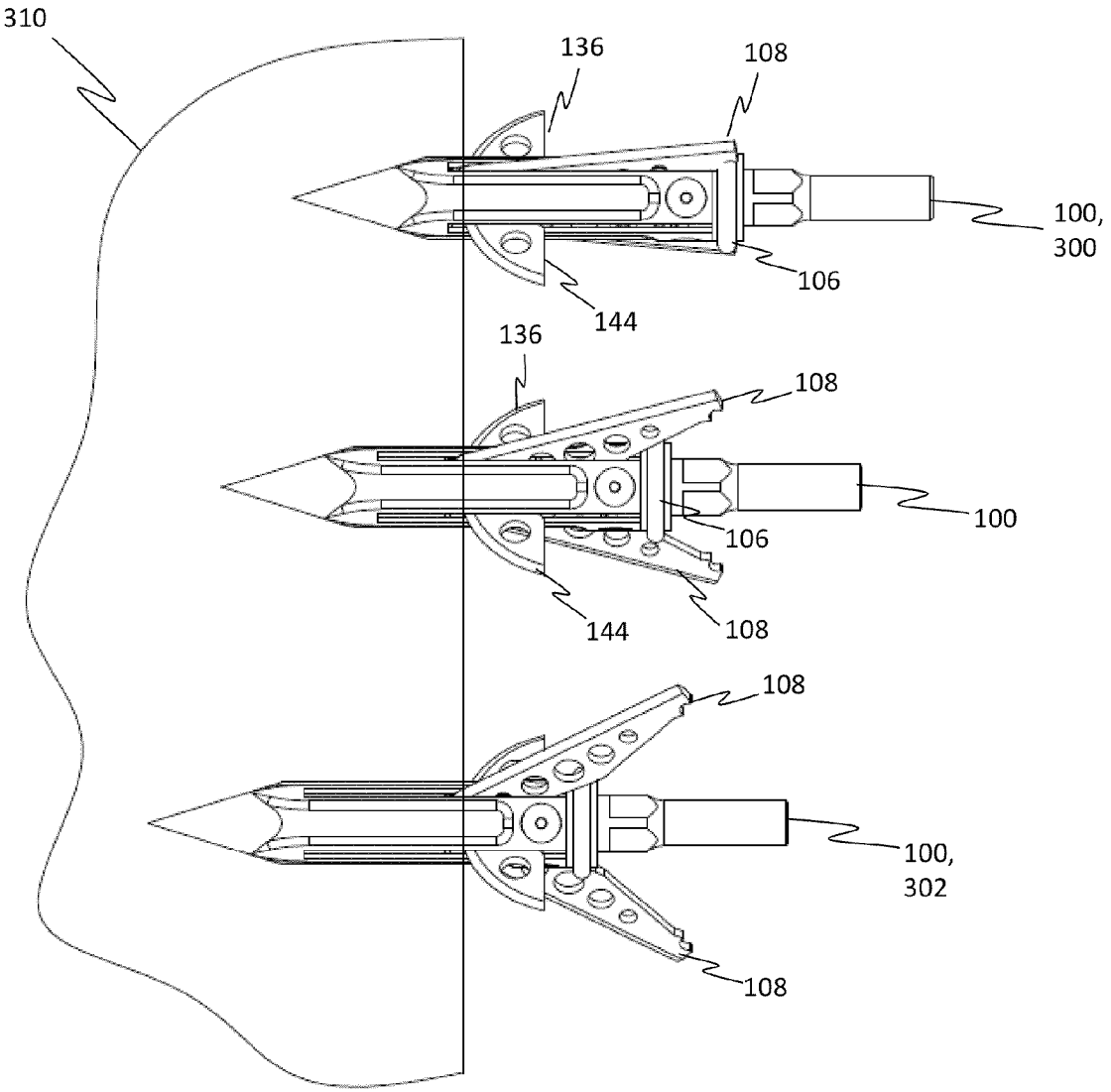
FIG. 10*a* is a side view of the broadhead arrowhead of FIG. 1, initially entering into a target body.
FIG. 10*b* is a side view of the broadhead arrowhead of FIG. 1, entering further into a target body.
FIG. 10*c* is a side view of the broadhead arrowhead of FIG. 1, entering almost completely into a target body.

In accordance with the present invention, the improved mechanical broadhead arrowhead 100 includes a non-deployed configuration 300 (shown in FIG. 8*a*, 8*b*, 8*c*, 8*d*) and a deployed configuration 302 (shown in FIG. 9*a*, 9*b*, 9*c*, 9*d*) and operates as follows. Referring to FIG. 10*a*, FIG. 10*b* and FIG. 10*c*, once the broadhead arrowhead 100 contacts a target object 310, the tip of the broadhead arrowhead enters the object 310. The blade portions 136, 144 contact the object which produces a pressure on blade portions 136, 144 pushing the blade portions 136, 144 toward the broadhead base 104. As the blade portions 136, 144 move toward the broadhead base 104, this causes the deployable blades 108 to pivot about its respective protruding member 142 thereby causing the deployable blades 108 to separate from the deployment O-Ring 106 such that the deployment O-Ring 106 is no longer located within the O-Ring cutout 162. As more pressure is applied to blade portions 136, 144, the blade base 138, 146 are forced to traverse the length L of the body cavity 128 toward broadhead base 104. Because the deployable blades 108 are pivotably associated with base protruding member 142, the first end 152 of deployable blades 108 also traverse the length L of body cavity 128 along with blade base 138, 146. This causes second end 154 of the deployable blades 108 to pivot outwardly away from broadhead base 104 in a rear deploying fashion. This configuration allows the broadhead arrowhead 100 to be centered in the target by having the blades at the rear of the broadhead arrowhead 100. The feature of this action make it less likely to deflect at severe angled shots and allows the four edged tip to penetrate deeper while loosening and separating material along the way giving the four blades less resistance and deeper penetration.

Figure 11:
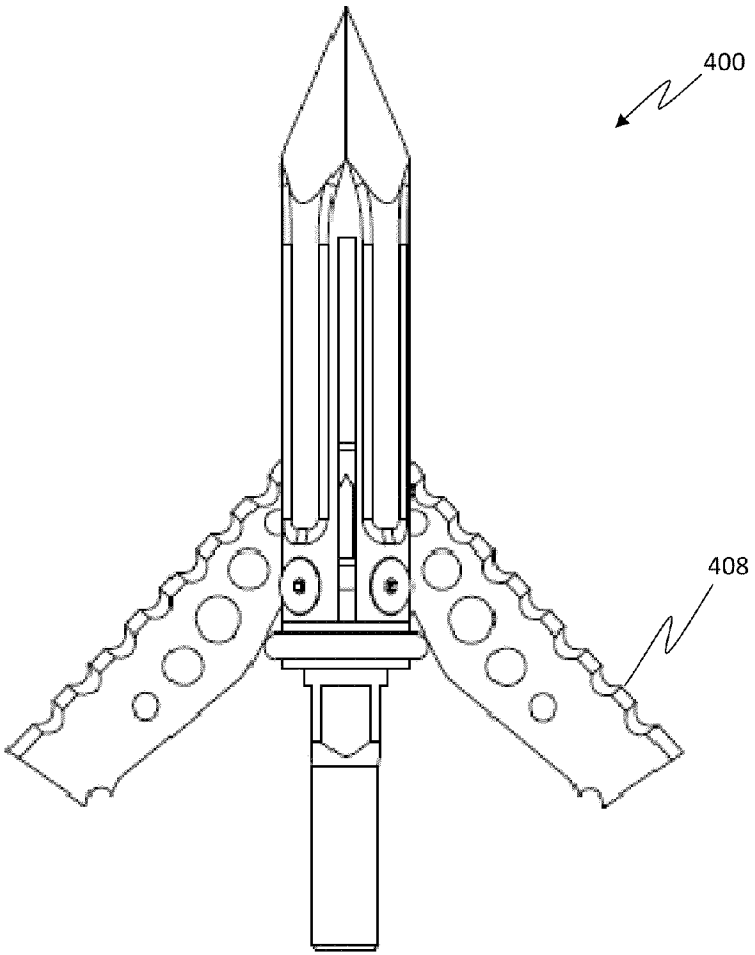
FIG. 11 is a side view of an improved mechanical broadhead arrowhead, in accordance with an additional embodiment of the present invention.
Figure 12:
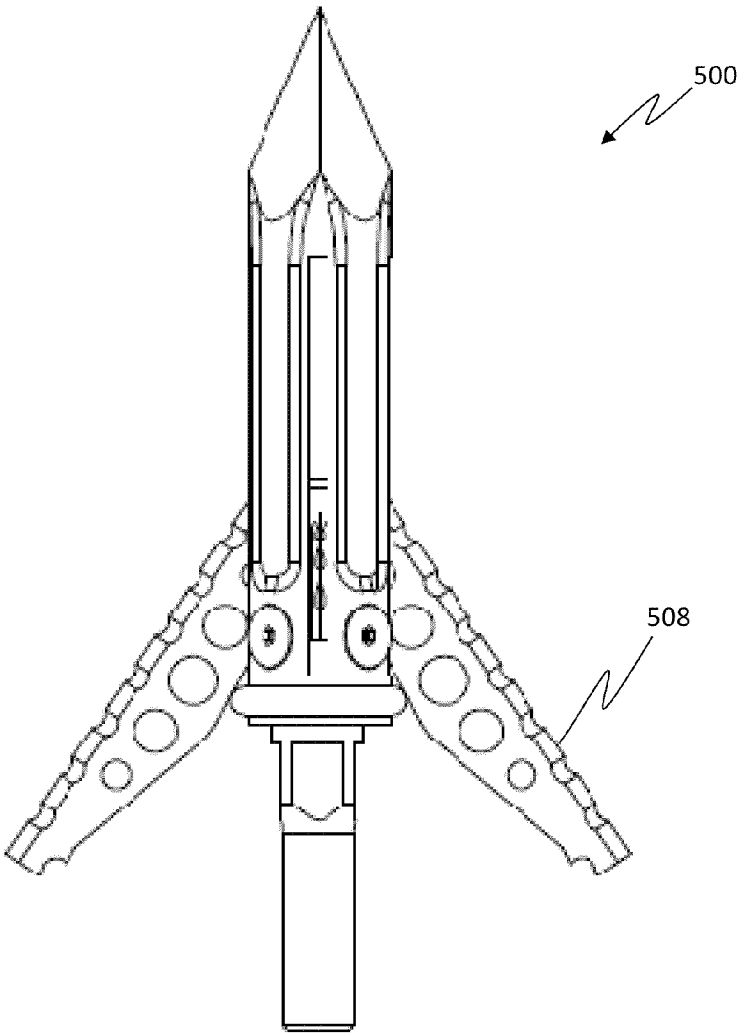
FIG. 12 is a side view of an improved mechanical broadhead arrowhead, in accordance with still yet another embodiment of the present invention.
Figure 13:
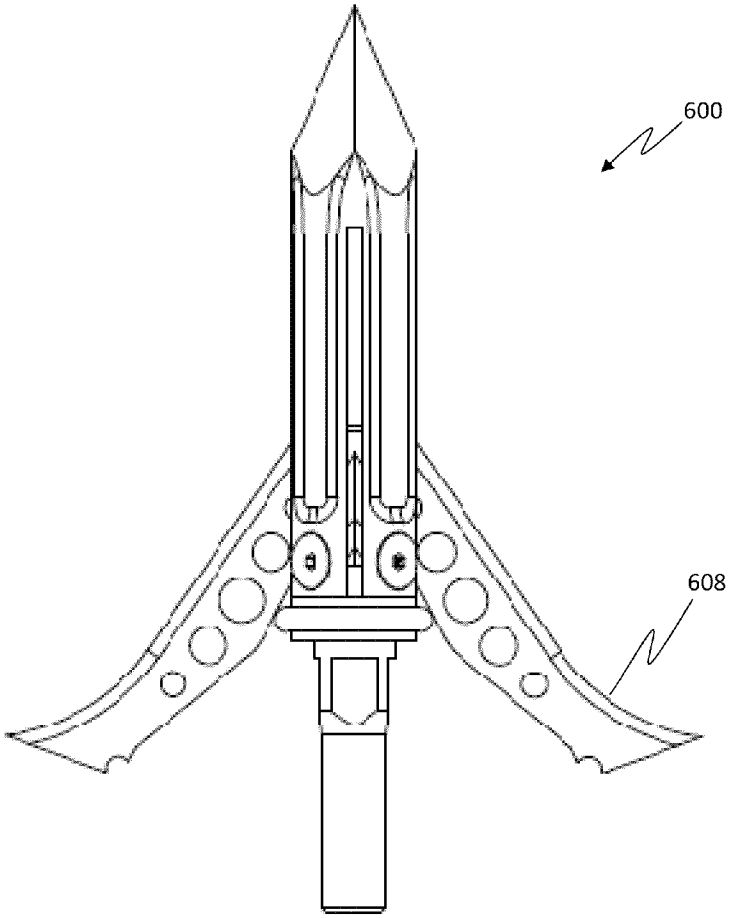
FIG. 13 is a side view of an improved mechanical broadhead arrowhead, in accordance with still yet another embodiment of the present invention.
Figure 14:
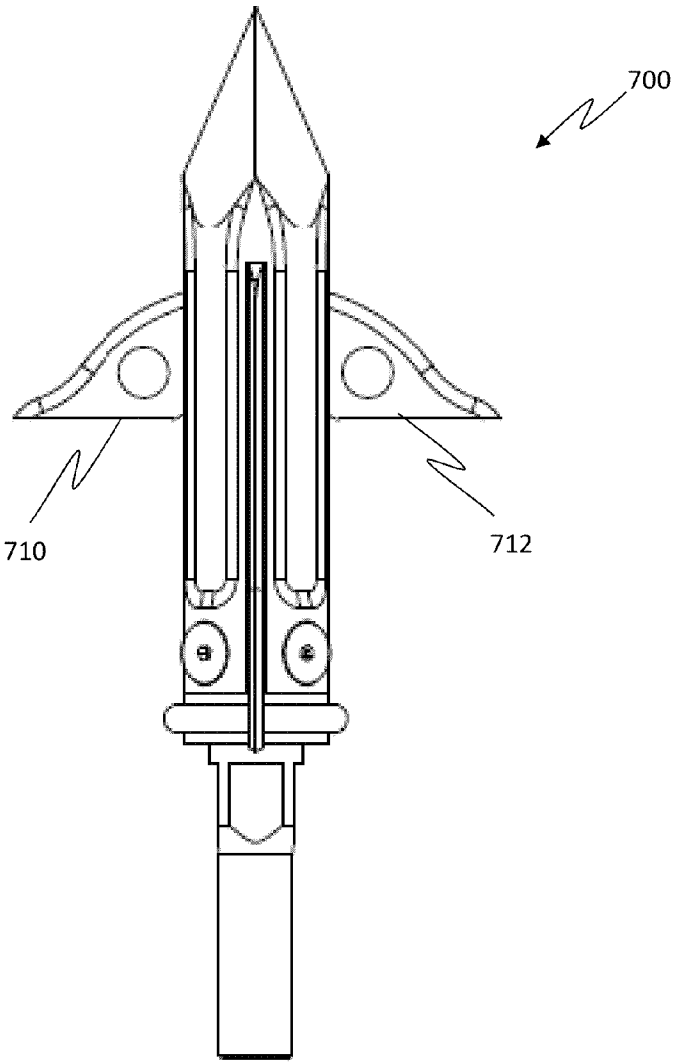
FIG. 14 is a side view of an improved mechanical broadhead arrowhead, in accordance with still yet another embodiment of the present invention.
Figure 15:
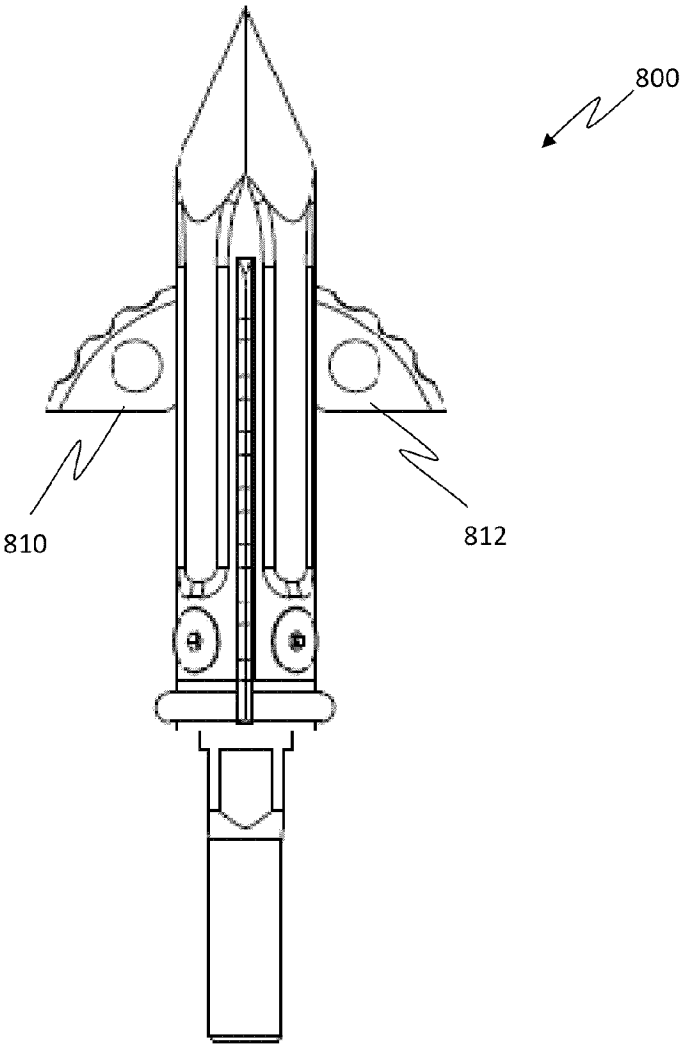
FIG. 15 is a side view of an improved mechanical broadhead arrowhead, in accordance with still yet another embodiment of the present invention.

It should be appreciated that various blade configurations may be used with both the deployable blades 108 and the minor blades 110, 112. Referring to FIG. 11, an improved mechanical broadhead arrowhead 400 in accordance with an additional embodiment of the present invention is shown and includes deployable blades 408 having a serrated edge. Referring to FIG. 12, an improved mechanical broadhead arrowhead 500 in accordance with still yet another embodiment of the present invention is shown and includes deployable blades 508 having a serrated edge and a streamlined wing configuration. Referring to FIG. 13, an improved mechanical broadhead arrowhead 600 in accordance with still yet another embodiment of the present invention is shown and includes deployable blades 608 having a sharpened knife edge and a 'feathered' wing configuration. Referring to FIG. 14, an improved mechanical broadhead arrowhead 700 in accordance with still yet another embodiment of the present invention is shown and includes minor blades 710, 712 having a sharpened knife edge and a 'feathered' wing configuration. Referring to FIG. 15, an improved mechanical broadhead arrowhead 800 in accordance with still yet another embodiment of the present invention is shown and includes minor blades 810, 812 having a serrated edge. It should be appreciated that the above (and other) configurations of blades are contemplated and may be used in any combination as desired.

Figure 16:
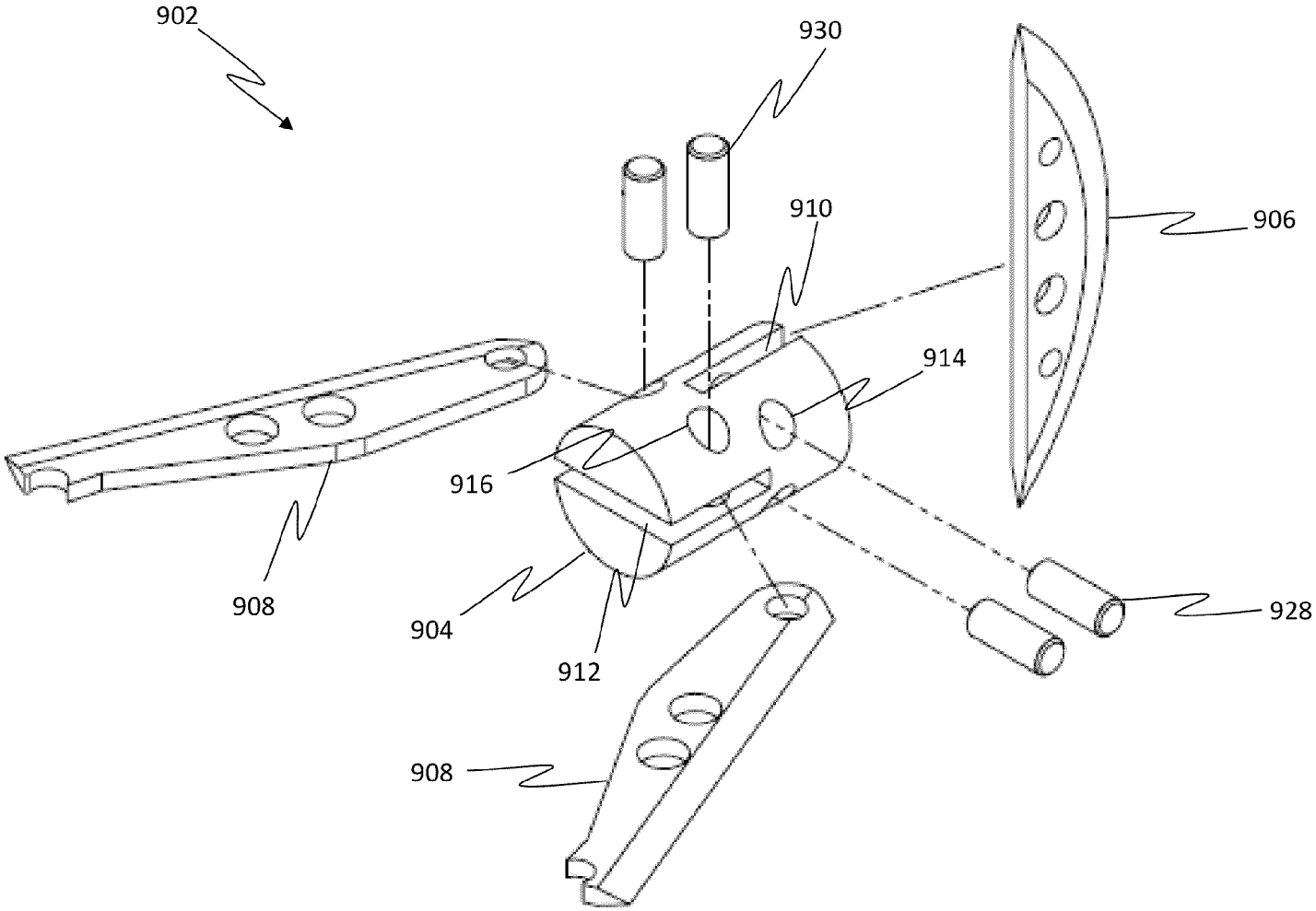
FIG. 16 is an exploded rear side perspective view of a deployable blade assembly, in accordance with an additional embodiment of the present invention.
Figure 17:
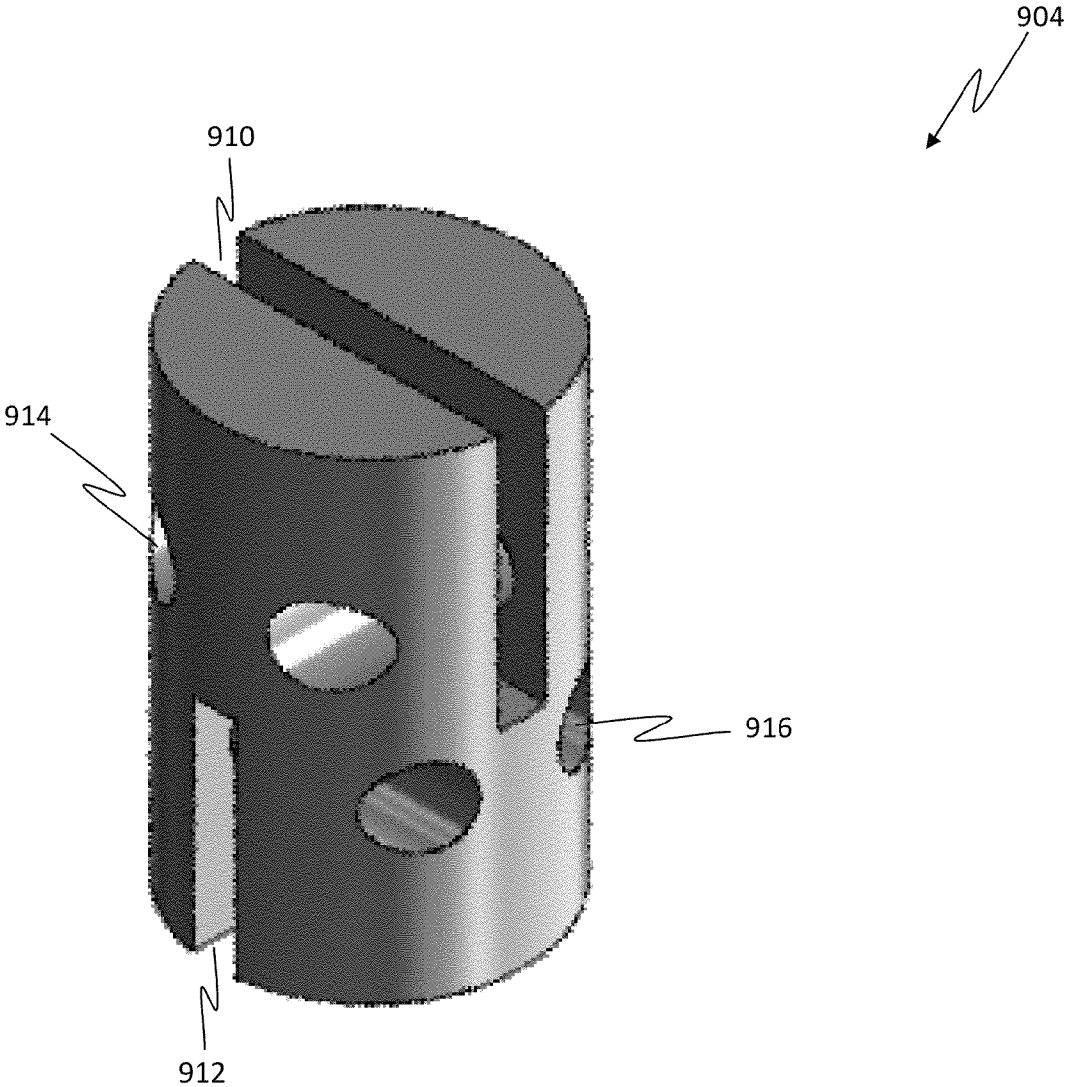
FIG. 17 is an isometric side view of a blade assembly center body of the deployable blade assembly of FIG. 16.
Figure 18:
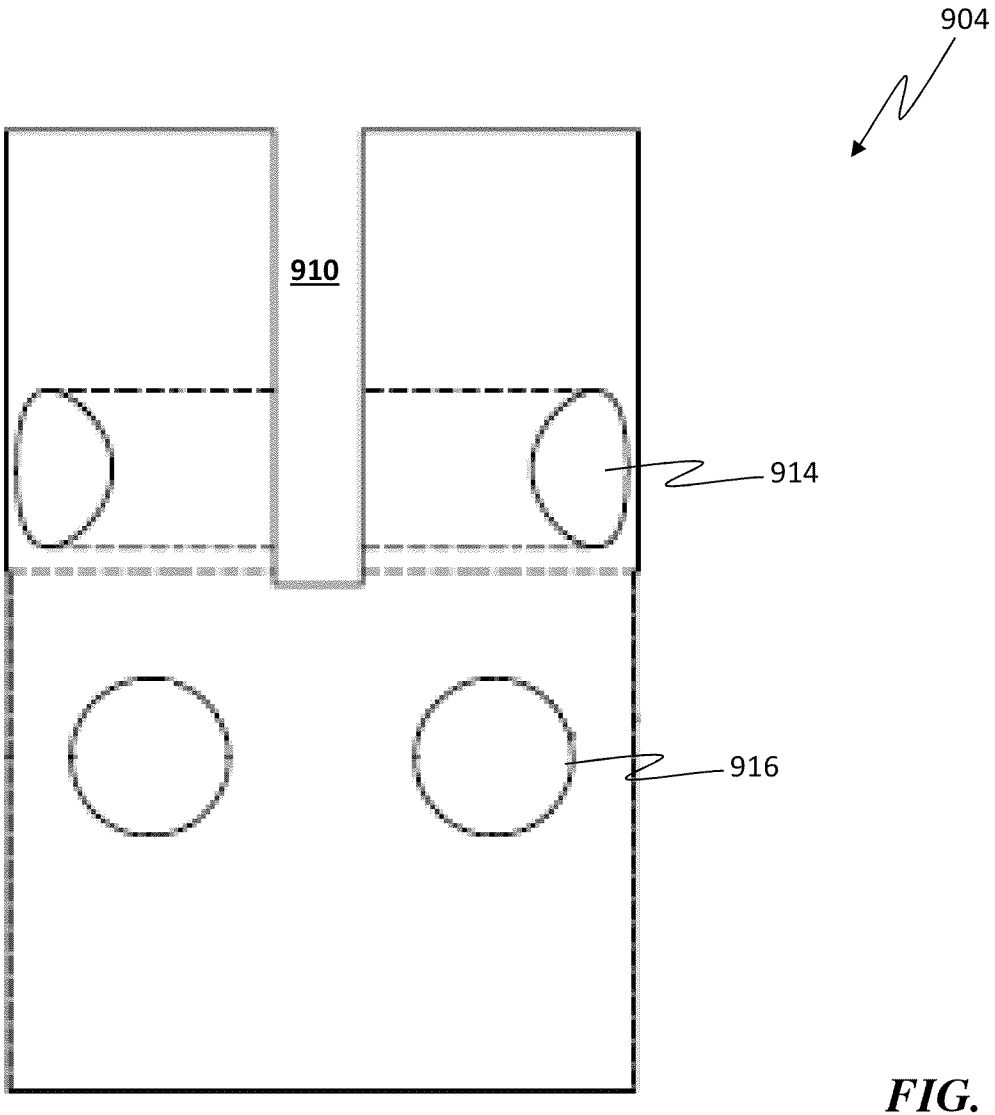
FIG. 18 is a side view of a blade assembly center body of the deployable blade assembly of FIG. 16.

Referring to FIG. 16, an additional embodiment of a broadhead arrowhead 900 is provided and includes a deployable blade assembly 902 having a blade assembly center body 904, a minor blade 906 and at least one deployable blade 908. It should be appreciated that the improved mechanical broadhead arrowhead 900 operates as discussed hereinabove with regards to the other embodiments 100, 400, 500, 600, 700, 800. Referring to FIG. 17 and FIG. 18, the blade assembly center body 904 defines a minor blade slot 910 and a blade slot 912. Additionally, the blade assembly center body 904 further defines at least one center body minor blade pin cavity 914 and at least one center body blade pin cavity 916, wherein the at least one center body minor blade pin cavity 914 is communicated with the minor blade slot 910 and the at least one center body blade pin cavity 916 is communicated with the blade slot 912.

Figure 19:
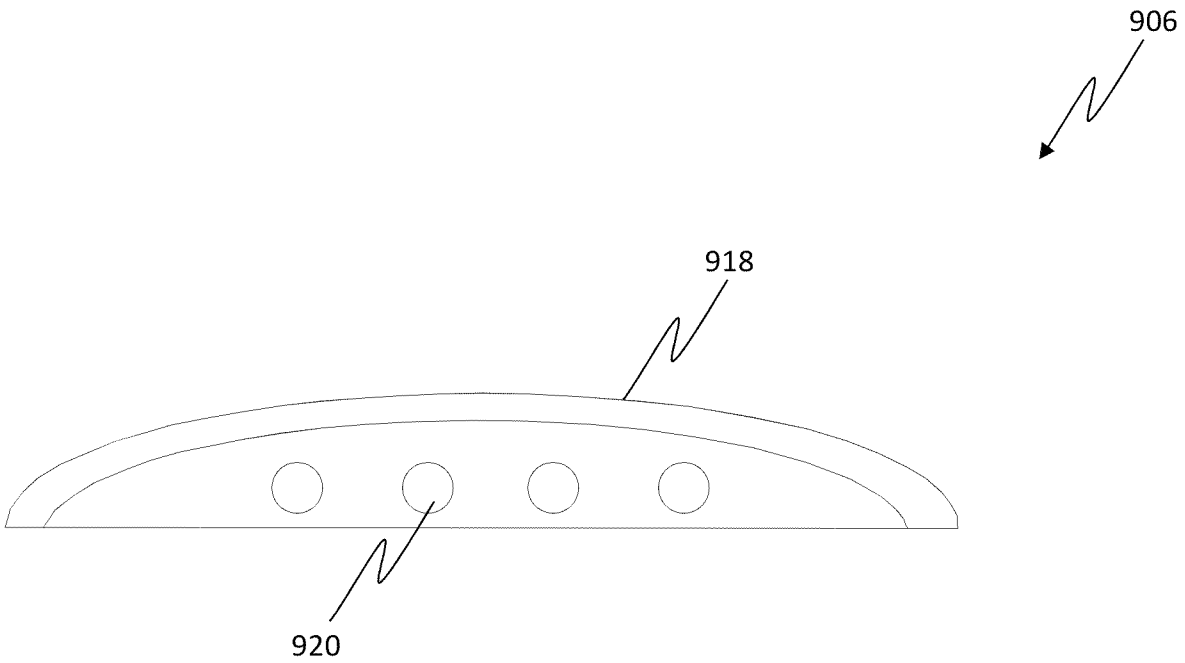
FIG. 19 is a side view of a minor blade used in the deployable blade assembly of FIG. 16.
Figure 20:
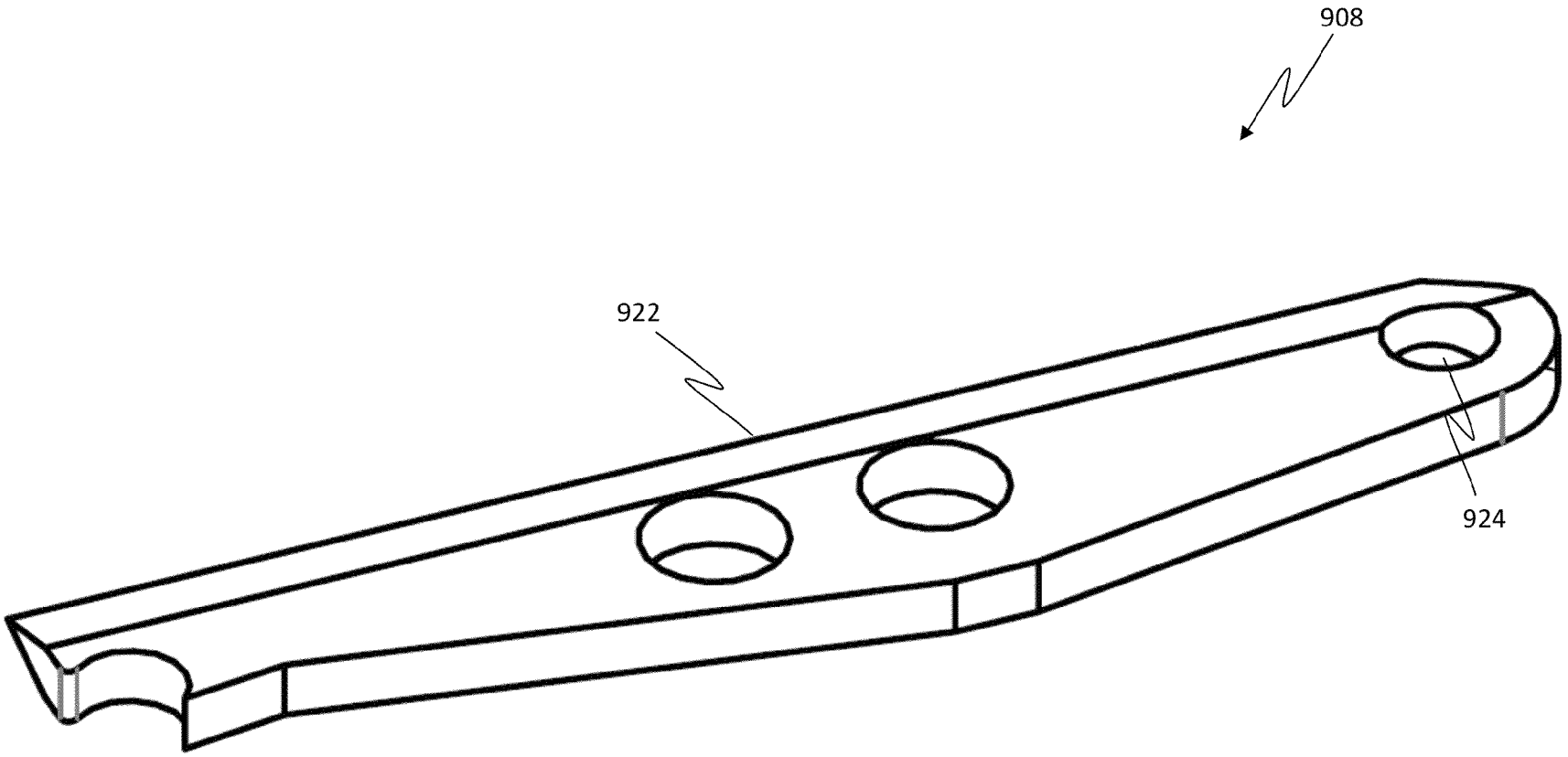
FIG. 20 is a side view of a deployable blade used in the deployable blade assembly of FIG. 16.
Figure 21:
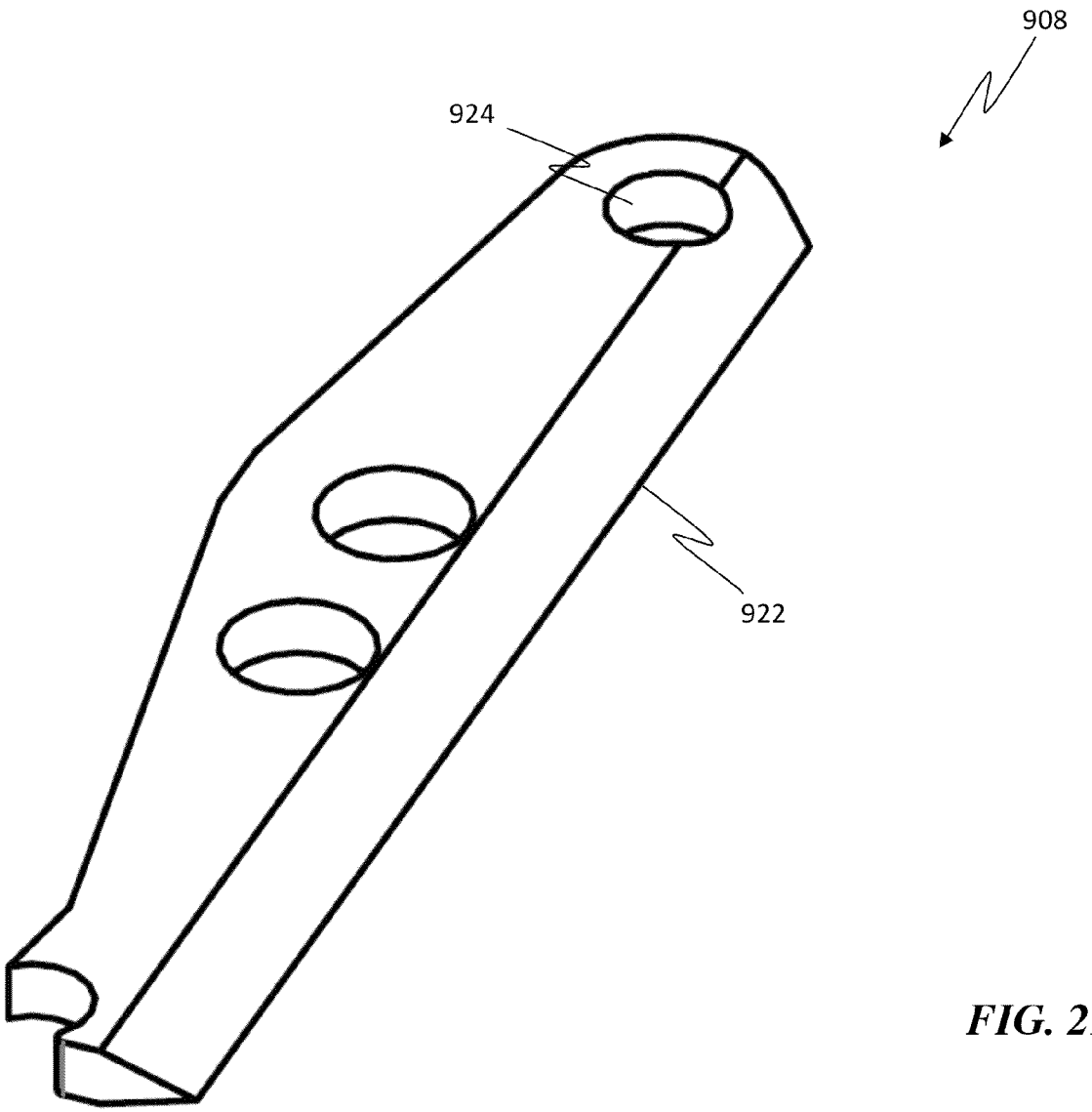
FIG. 21 is a side view of a deployable blade used in the deployable blade assembly of FIG. 16.

Referring to FIG. 19, the at least one minor blade 906 includes a minor blade interface edge 918 and at least one minor blade mounting cavity 920, wherein the at least one minor blade mounting cavity 920 and the at least one center body minor blade pin cavity 914 are similarly shaped. Referring to FIG. 20 and FIG. 21, the at least one deployable blade 908 includes a deployable blade interface edge 922 and at least one deployable blade mounting cavity 924, wherein the at least one deployable blade mounting cavity 924 and the at least one center body blade pin cavity 916 are similarly shaped. It should be appreciated that in an additional embodiment, the blade assembly center body 904 and the minor blade 906 may be constructed as one piece or the minor blade 906 may be permanently attached to the blade assembly center body 904 via any method or device suitable to the desired end purpose, such as by epoxy, welding, etc.

Referring again to FIG. 16, the deployable blade assembly 902 further includes at least one minor blade mounting pin 928 which is sized and shaped to fit within the at least one minor blade mounting cavity 920 and the at least one center body minor blade pin cavity 914. Additionally, the deployable blade assembly 902 further includes at least one blade mounting pin 930 which is sized and shaped to fit within the at least one deployable blade mounting cavity 924 and the at least one center body blade pin cavity 916.

Referring again to FIG. 16, the at least one minor blade 906 is located within the minor blade slot 910 such that the at least one minor blade mounting cavity 920 is aligned with the at least one center body minor blade mounting cavity 914. The at least one minor blade mounting pin 928 is located within the at least one minor blade mounting cavity 920 and the at least one center body minor blade mounting cavity 914. Additionally, the at least one deployable blade 908 is located within the blade slot 912 such that the at least one deployable blade mounting cavity 924 is aligned with the at least one center body blade pin cavity 916. The at least one blade mounting pin 930 is located within the at least one deployable blade mounting cavity 924 and the at least one center body blade mounting cavity 916. The deployable blade assembly 902 is then located within the broadhead body 102, where the broadhead body 102 keeps the at least one minor blade mounting pin 928 and the at least one blade mounting pin 930 in place. It should be appreciated that the at least one blade mounting pin 930 should be sized such that at least one deployable blade 908 is movable such that the at least one deployable blade 908 is deployable between the undeployed configuration and the deployed configuration.

Figure 22:
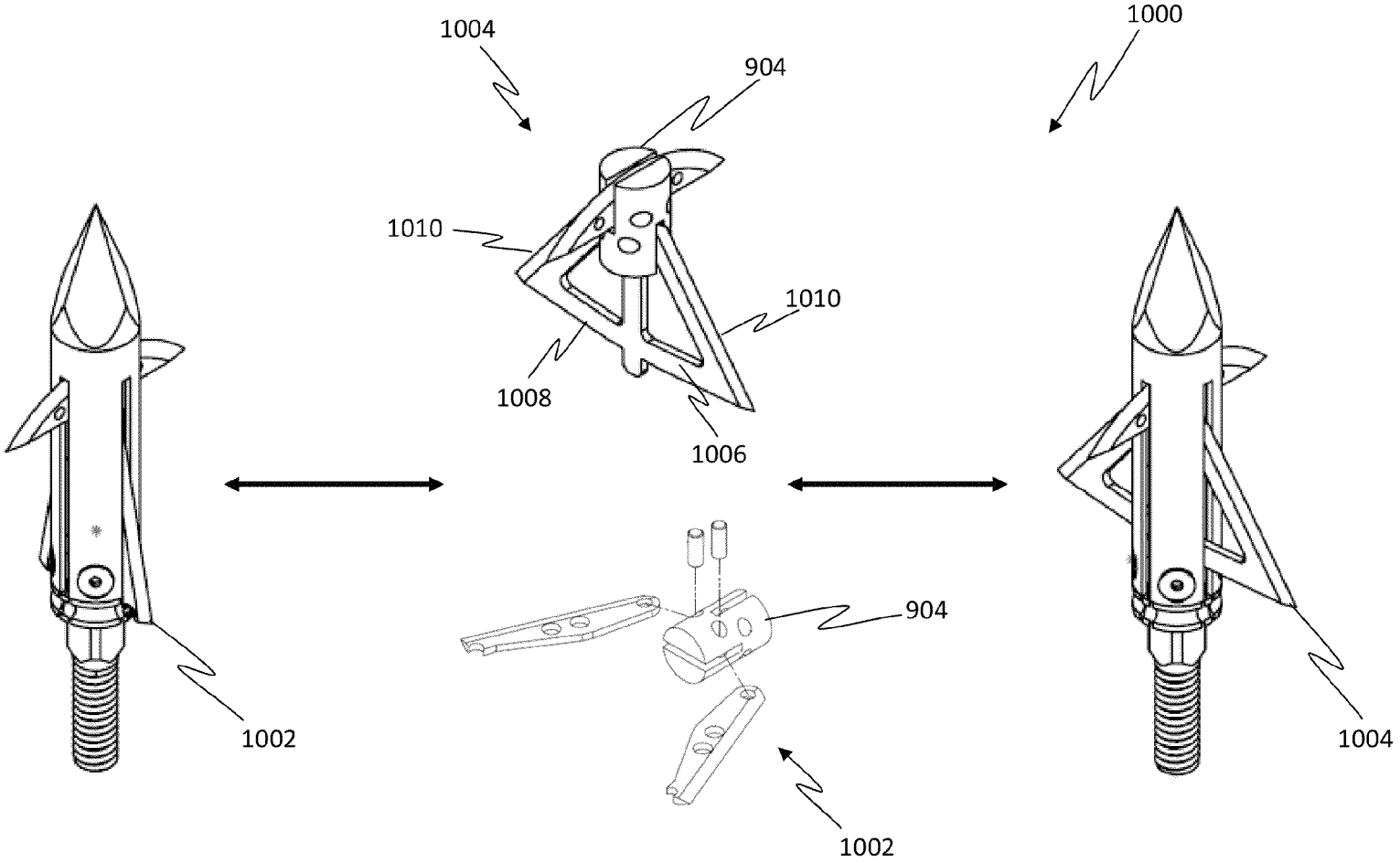
FIG. 22 is a side isometric view of a configurable broadhead arrowhead in accordance with an additional embodiment of the invention.
Figure 23:
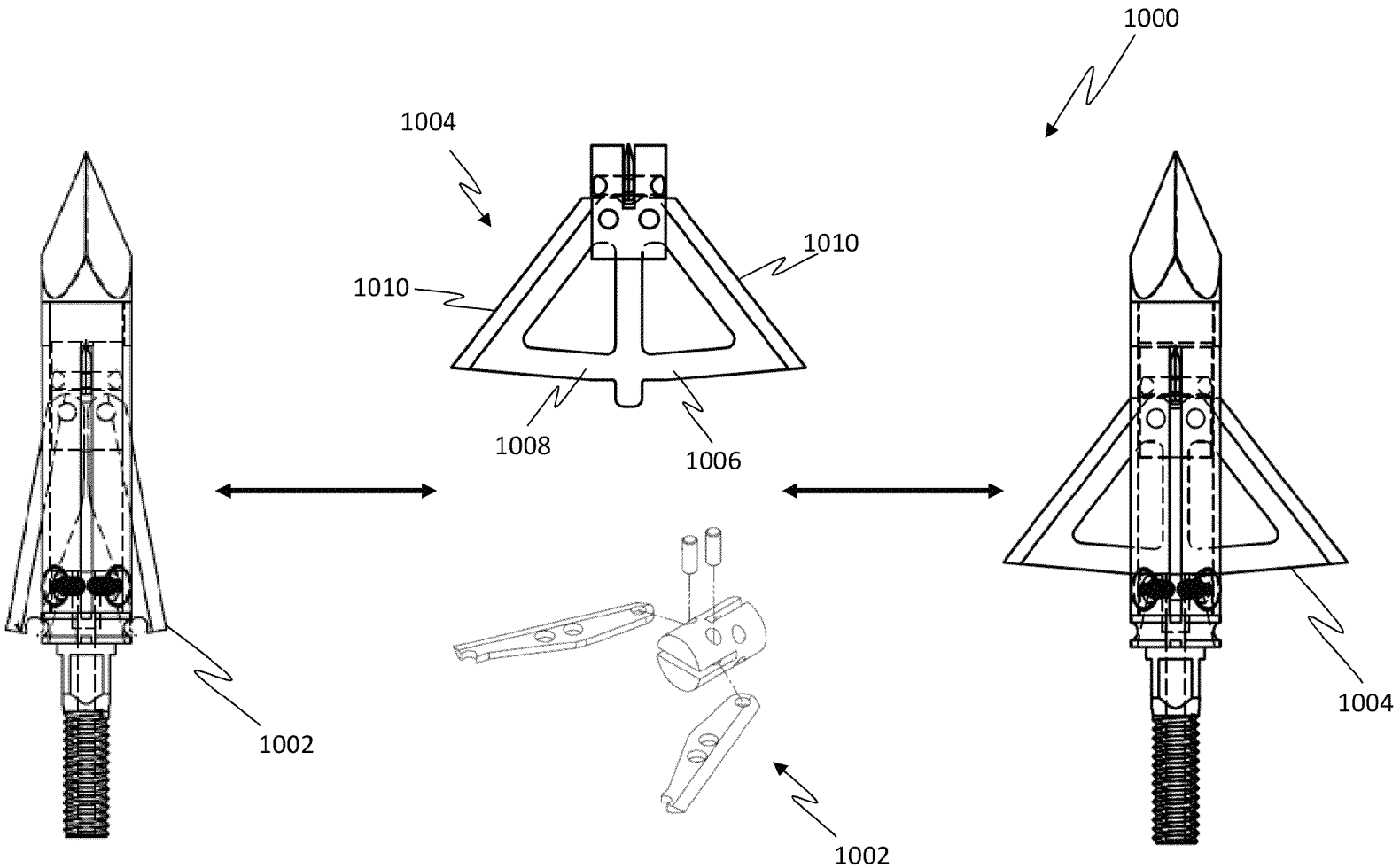
FIG. 23 is a side sectional view of a configurable broadhead arrowhead of FIG. 22.
Figure 24:
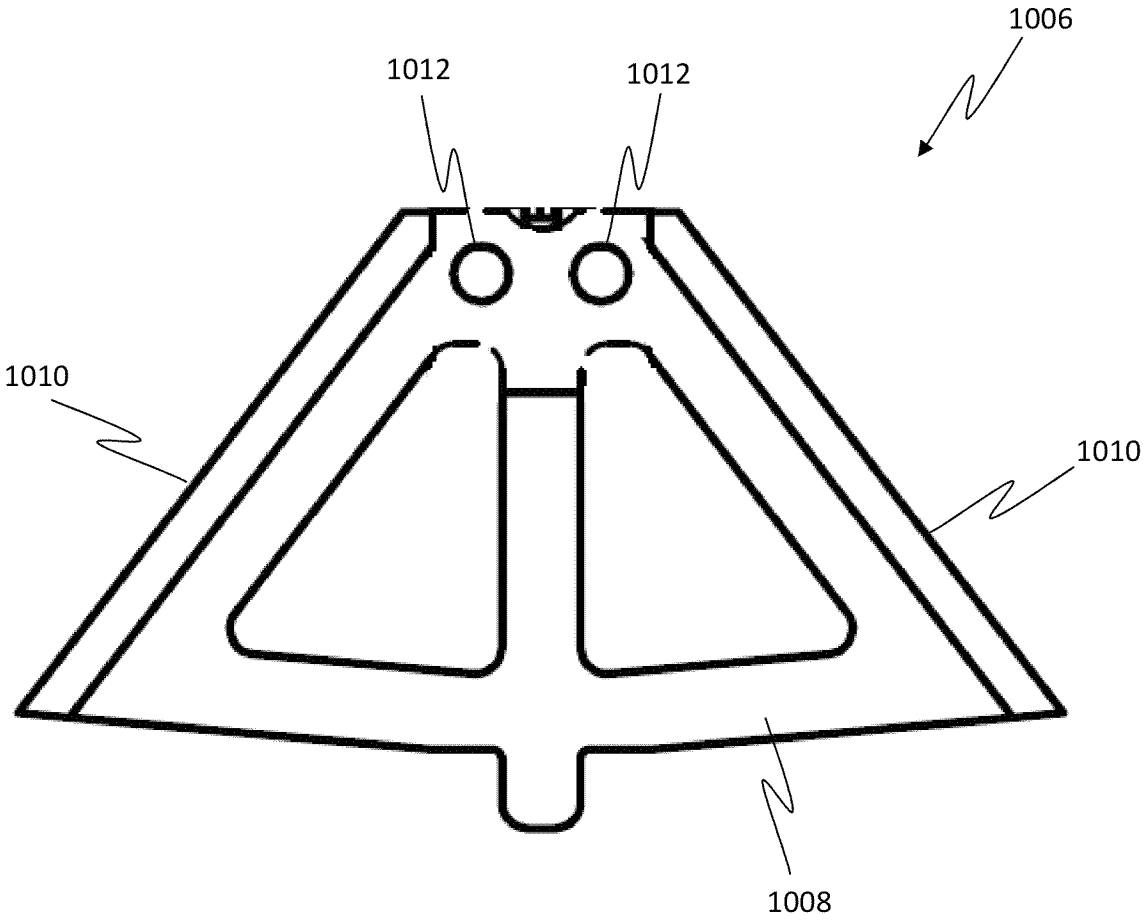
FIG. 24 is a side view of the fixed blade insert of the configurable broadhead arrowhead of FIG. 22.
Figure 25:
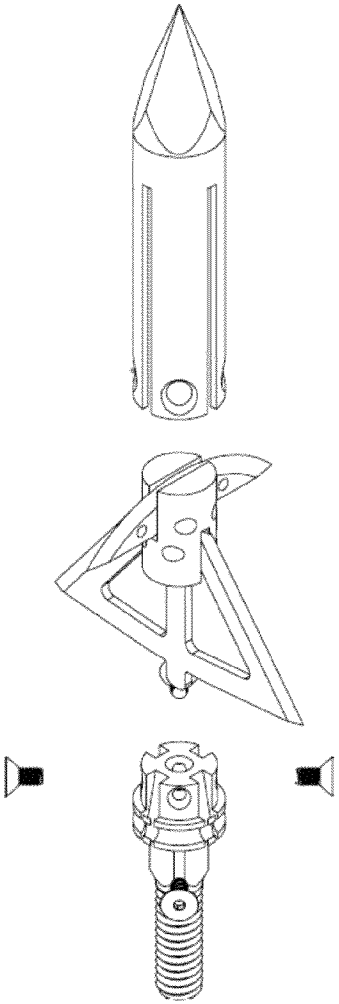
FIG. 25 is a side isometric view of a configurable broadhead arrowhead of FIG. 22.

Referring to FIG. 22 and FIG. 23, an additional embodiment of a broadhead arrowhead 1000 is provided wherein the broadhead arrowhead 1000 is configurable between a broadhead arrowhead 1000 having a deployable blade assembly 1002 and a broadhead arrowhead 1000 having a fixed (non-deployable) blade assembly 1004. It should be appreciated that the broadhead arrowhead 1000 may be configured having a deployable blade assembly 1002 as shown and discussed hereinbefore with regards to FIG. 16. To configure the broadhead arrowhead 1000 into an arrowhead having a fixed blade system, the deployable blade assembly 1002 is removed and replaced with the fixed blade assembly 1004, wherein the fixed blade assembly 1004 includes a fixed blade insert 1006, having a blade insert body 1008, at least one insert blade surface 1010 and at least one fixed blade body mounting hole 1012 (See FIG. 24). It should be appreciated that although the fixed blade insert 1006 is shown as being constructed as a single blade insert body, it is contemplated that the fixed blade insert 1006 may be of a multi-piece construction.

It should be appreciated the broadhead arrowhead 1000 may be configured between the deployable blade assembly 1002 and the fixed blade assembly 1004 by removing the mounting screws and disassociated the broadhead body 102 from the broadhead base 104 of the broadhead arrowhead 1000 to exposed the blade assembly center body 904 which is removed from the body cavity of the broadhead body 102. The deployable blades 908 (or fixed blade insert 1006) are removed from the blade assembly center body 904 and replaced with the fixed blade insert 1006 (or deployable blades 908) by sliding the fixed blade insert 1006 into the blade slot 912 such that the at least one fixed blade mounting hole 1012 is aligned with the at least one center body blade pin cavity 916. The at least one blade mounting pin 930 is then associated with the blade assembly center body 904 and the at least one fixed blade body mounting hole 1012 to secure the blade insert body 1008 with the blade assembly center body

904. The blade assembly center body 904 is located inside the body cavity of the broadhead body 102 and the broadhead body 102 is securely associated with the broadhead base 104 via the mounting screws.

In accordance with the present invention, one or more of the components of the mechanical broadhead arrowhead 100, 400, 500, 600, 700, 800, 900, 1000 of the present invention may be manufactured using any method or technique suitable to the desired end purpose. For example, in one embodiment one or more components of the mechanical broadhead arrowhead 100, 400, 500, 600, 700, 800, 900, 1000 may be constructed from metal using metal injection molding. While in another embodiment one or more components of the mechanical broadhead arrowhead 100, 400, 500, 600, 700, 800, 900, 1000 may be constructed using powder injection molding. Moreover, it is contemplated that the one or more of the components of the mechanical broadhead arrowhead 100, 400, 500, 600, 700, 800, 900, 1000 may be constructed from a plastic material, a composite material, a metal material or a combination thereof. In accordance with one embodiment of the present invention, deployment O-Ring 106 may be constructed from a plastic, rubber and/or a composite material, such as a neoprene or polychloroprene type material that may be resistant to oil, ozone, weather, detergent, temperature and/or salt water. However, it should be appreciated that deployment O-Ring 106 may be constructed from any material or combination of materials suitable to the desired end purpose.

In accordance with the present invention, the processing of the method 200 in FIG. 6 may be implemented, wholly or partially, by a controller operating in response to a machine-readable computer program. In order to perform the prescribed functions and desired processing, as well as the computations therefore (e.g. execution control algorithm(s), the control processes prescribed herein, and the like), the controller may include, but not be limited to, a processor(s), computer(s), memory, storage, register(s), timing, interrupt (s), communication interface(s), and input/output signal interface(s), as well as combination comprising at least one of the foregoing.

Moreover, the method of the present invention may be embodied in the form of a computer or controller implemented processes. The method of the invention may also be embodied in the form of computer program code containing instructions embodied in tangible media, such as floppy diskettes, CD-ROMs, hard drives, and/or any other computer-readable medium, wherein when the computer program code is loaded into and executed by a computer or controller, the computer or controller becomes an apparatus for practicing the invention. The invention can also be embodied in the form of computer program code, for example, whether stored in a storage medium, loaded into and/or executed by a computer or controller, or transmitted over some transmission medium, such as over electrical wiring or cabling, through fiber optics, or via electromagnetic radiation, wherein when the computer program code is loaded into and executed by a computer or a controller, the computer or controller becomes an apparatus for practicing the invention. When implemented on a general-purpose microprocessor the computer program code segments may configure the microprocessor to create specific logic circuits.

It should be appreciated that while the invention has been described with reference to an exemplary embodiment, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. An broadhead arrowhead, wherein the arrowhead is configurable between a fixed blade system and a deployable blade system, comprising:

a broadhead body having a body opening and a body length, wherein the broadhead body defines a body cavity and includes a first, second, third and fourth slot each of which having a slot length that traverses a portion of the body length;

a minor blade system having a first curved surface and a second curved surface, wherein the minor blade system is associated with the broadhead body such that the first curved surface and second curved surface are protruding from opposing sides of the broadhead body; and a primary blade system configurable between a deployable blade system and a fixed blade system, wherein when the primary blade system is configured as a deployable blade system, the minor blade system is movably associated with the broadhead body and the deployable blade system includes, a first deployable blade having a first interface hole and a first blade edge;

a second deployable blade having a second interface hole and a second blade edge, wherein the first deployable blade and second deployable blade are associated with the minor blade system such that movement of the minor blade system causes movement of the deployable blade system, wherein the first and second deployable blades are protruding from opposing sides of the broadhead body, and when the primary blade system is configured as a fixed blade system, the minor blade system is non-movably associated with the broadhead body and the fixed blade system includes, a blade insert body non-movably associated with the broadhead body, wherein the blade insert body includes a first insert blade surface and a second insert blade surface, wherein the first and second insert blade surfaces are protruding from opposing sides of the broadhead body, and a broadhead base having a base head, wherein the base head is configured to be securely associated with the body opening to be partially disposed within the body cavity to enclose the body cavity.

2. The broadhead arrowhead of claim 1, wherein the base head includes an O-Ring channel running along the circumference of the base head.

3. The broadhead arrowhead of claim 2, further comprising an O-Ring disposed within the O-Ring channel.

4. The broadhead arrowhead of claim 2, wherein when the first and second minor blades are located away from the broadhead base, the first and second deployable blades are in a non-deployed configuration.

5. The broadhead arrowhead of claim 4, wherein the first and second deployable blades include an O-Ring cutout, wherein when the first and second deployable blades are in a non-deployed configuration, at least a portion of an O-Ring is at least partially disposed within the O-Ring cutout.

6. The broadhead arrowhead of claim 1, wherein the first and second minor blades and first and second deployable blades are movable along at least a portion of the length of the broadhead body to allow the first and second deployable blades to be configured between a non-deployed configuration into a deployed configuration.

7. The broadhead arrowhead of claim 1, wherein when the first and second minor blades are located proximate the broadhead base, the first and second deployable blades are in a deployed configuration.

* * * * *